US010168023B1

(12) United States Patent
Hein

(10) Patent No.: US 10,168,023 B1
(45) Date of Patent: Jan. 1, 2019

(54) REFLECTOR BASED ILLUMINATION SYSTEM

(71) Applicant: William A. Hein, Manhattan Beach, CA (US)

(72) Inventor: William A. Hein, Manhattan Beach, CA (US)

(73) Assignee: NLS Lighting, LLC, Rancho Dominguez, CA (US)

( * ) Notice: Subject to any disclaimer, the term of this patent is extended or adjusted under 35 U.S.C. 154(b) by 381 days.

(21) Appl. No.: 14/925,707

(22) Filed: Oct. 28, 2015

(51) Int. Cl.
*F21V 7/04* (2006.01)
*F21S 8/08* (2006.01)
*F21V 7/16* (2006.01)

(52) U.S. Cl.
CPC ..... *F21V 7/048* (2013.01); *F21S 8/086* (2013.01); *F21V 7/16* (2013.01)

(58) Field of Classification Search
CPC ..... F21S 8/086; F21V 7/0025; F21V 7/048; F21W 2131/103
USPC ..... 362/431
See application file for complete search history.

(56) References Cited

U.S. PATENT DOCUMENTS 3,991,339 A * 11/1976 Lockwood ..... H01L 33/20 257/98
6,168,295 B1 * 1/2001 Hein ..... F21S 8/00 362/145
7,213,948 B2 5/2007 Hein
7,347,706 B1 * 3/2008 Wu ..... H01R 13/7175 430/642
7,674,018 B2 3/2010 Holder et al.
8,092,032 B2 1/2012 Pearse
8,322,881 B1 * 12/2012 Wassel ..... F21V 7/00 362/217.05
8,485,684 B2 * 7/2013 Lou ..... F21V 7/005 362/217.05
8,905,597 B2 12/2014 Holder et al.
8,946,360 B2 2/2015 Chiefari et al.
8,956,012 B2 2/2015 Park
9,062,842 B2 * 6/2015 Huh ..... F21V 7/0033
9,541,255 B2 * 1/2017 Sferra ..... F21V 7/0066
9,699,854 B2 * 7/2017 Wassel ..... H05B 33/0854
2005/0157490 A1 * 7/2005 Klose ..... F21S 8/024 362/146
2007/0115655 A1 * 5/2007 Kaminski ..... B63B 45/06 362/227
2008/0062689 A1 * 3/2008 Villard ..... F21V 14/02 362/249.07

(Continued)

*Primary Examiner* — Robert J May
*Assistant Examiner* — Leah S MacChiarolo
(74) *Attorney, Agent, or Firm* — Advantage IP Law Firm

(57) ABSTRACT

A reflector based illumination system having a mounting insert with at least one primary reflective surface recessed from the opening of a housing and at least one circuit board with a light source operable to be placed in communication with a power source positioned adjacent at least one auxiliary reflective surface mounted at an angle to the primary reflective surface to cooperate with the light source to emit a quantity of incident light toward primary reflective surface, a quantity of incident light toward the auxiliary reflective surface, and a quantity of unobstructed light through the opening, with all three quantities cooperating to illuminate an exterior surface when the light source is placed in communication with the power source through the circuit board and energized to generate light.

20 Claims, 17 Drawing Sheets

(56) References Cited

U.S. PATENT DOCUMENTS

| | | | | |
|---|---|---|---|---|
| 2008/0089069 | A1* | 4/2008 | Medendorp | F21S 8/04 362/294 |
| 2010/0172131 | A1* | 7/2010 | Mo | F21V 11/04 362/234 |
| 2011/0149566 | A1* | 6/2011 | Lin | F21S 8/086 362/235 |
| 2011/0261565 | A1* | 10/2011 | Gerli | F21V 7/0008 362/235 |
| 2012/0026737 | A1* | 2/2012 | Dinc | F21S 8/086 362/247 |

* cited by examiner

Calculation Summary (702)

| Label (718) | CalcType (704) | Units (706) | Avg (708) | Max (710) | Min (712) | Avg/Min (714) | Max/Min (716) |
|---|---|---|---|---|---|---|---|
| CalcPts (720) | Illuminance | Fc | 42.75 | 61.7 | 30.8 | 1.39 | 2.00 |
| FIRST ROW POINTS (722) | Illuminance | Fc | 50.01 | 61.7 | 38.6 | 1.30 | 1.60 |
| SECOND ROW POINTS | Illuminance | Fc | 44.73 | 52.4 | 37.3 | 1.20 | 1.40 |
| THIRD ROW POINTS (724) | Illuminance | Fc | 33.32 | 36.0 | 30.8 | 1.08 | 1.17 |

802 Calculation Summary

| Label 818 | CalcType 804 | Units 806 | Avg 808 | Max 810 | Min 812 | Avg/Min 814 | Max/Min 816 |
|---|---|---|---|---|---|---|---|
| CalcPts 820 | Illuminance | Fc | 59.09 | 117 | 25.8 | 2.29 | 4.54 |
| FIRST ROW POINTS 822 | Illuminance | Fc | 81.40 | 117 | 49.0 | 1.66 | 2.39 |
| SECOND ROW POINTS | Illuminance | Fc | 59.80 | 74.9 | 41.5 | 1.44 | 1.80 |
| THIRD ROW POINTS 824 | Illuminance | Fc | 32.45 | 38.4 | 25.8 | 1.26 | 1.49 |

902 906 908 910 912 914 916 918

904

920a-i

| Calculation Summary | | | | | | | |
|---|---|---|---|---|---|---|---|
| **Label** | **CalcType** | **Units** | **Avg** | **Max** | **Min** | **Avg/Min** | **Max/Min** |
| ENTIRE COURT | Illuminance | Fc | 52.22 | 73 | 33 | 1.58 | 2.21 |
| PPA-1 | Illuminance | Fc | 53.80 | 63 | 47 | 1.14 | 1.34 |
| PPA-2 | Illuminance | Fc | 56.20 | 63 | 50 | 1.12 | 1.26 |
| PPA-3 | Illuminance | Fc | 58.40 | 65 | 52 | 1.12 | 1.25 |
| PPA-4 | Illuminance | Fc | 48.80 | 60 | 44 | 1.11 | 1.36 |
| PPA-5 | Illuminance | Fc | 58.40 | 65 | 52 | 1.12 | 1.25 |
| PPA-6 | Illuminance | Fc | 56.20 | 63 | 50 | 1.12 | 1.26 |
| PPA-7 | Illuminance | Fc | 53.80 | 63 | 47 | 1.14 | 1.34 |
| PPA | Illuminance | Fc | 53.33 | 65.0 | 44.0 | 1.21 | 1.48 |

FIG. 14A

REFLECTOR BASED ILLUMINATION SYSTEM

BACKGROUND OF THE INVENTION

1. Field of the Invention

The present invention relates to lighting devices, and more specifically, to lighting devices using reflectors to illuminate one or more areas in either outdoor or indoor settings.

2. Background Art

In general, lighting fixtures, especially those in outdoor settings, are mounted on lamp or other support posts above an area to be illuminated. Examples of typical settings include tennis courts, outdoor basketball courts, parking areas outside retail shops or street parking, and automobile dealers. In each setting, a lamp post generally supports at least one lighting element of sufficient intensity and at a desired height to illuminate a desired surface or object with a preferred amount of light. Depending on the use or setting, the lighting requirements or desired lighting characteristics drive the choice of lighting element, installation height, housing shape, number of lighting elements, and angle of mounting. These choices are often driven by the need to achieve the light level recommendations of the IES (Illuminating Engineer Society) for a given lighting application.

Typically, the lighting element selected is in the form of one or more filaments based (incandescent) bulbs or gas containing tubes. The bulb or tube is typically mounted in a socket located within a housing and suspended at the desired height. In some cases, reflectors may be used to magnify the light emissions and direct the light in a chosen direction. One example may be found in U.S. Pat. No. 7,213,948 to Hein.

More recently, however, the lighting elements or light sources are being provided by light emitting diodes (LEDs). The LEDs emit less heat, last longer, and throw out a comparable or improved light emission compared to their incandescent and gas filled counterparts as measured in foot candles (Fc). Conventionally, the LEDs are mounted in a housing that may include a fixed rearmost reflector. One such example may be found in U.S. Pat. No. 7,347,706 to Wu et al. The Wu patent discloses an LED based street light that includes a lamp module for use with a threaded electrical socket connector. The lamp module includes a set of four LEDs mounted on a circuit that emit light through a lens. A fixed reflector backing provided in the original housing configuration is positioned behind the LEDs. The lamp module screws into an existing threaded electrical socket to replace a conventional incandescent light bulb. Despite using LEDs in conjunction with a rear recessed reflector, there are several drawbacks of such system. For example, the rear recessed reflector is fixed in position and not adjustable to vary the illumination characteristics of the lamp. The retrofit lamp module provides no accommodation for varying the reflective surface as the user is stuck with the conventional housing. This prevents the user from taking advantage of other reflector positions to alter both the direction and intensity of the light to capture a wider area of illumination for example. In addition, most of the light emitted from the LEDs passes directly through the lens and does not strike the rear recessed reflector. While the Wu patent provides one solution for retrofitting an existing incandescent bulb illumination device, in many situations, it would be advantageous to amplify the light emitted from the LEDs or throw the light in alternative directions to increase the illuminance on a surface that is illuminated by the lamp.

Current LED optical technology often uses fixed hydroformed aluminum reflector technology, or plastic refractive lens technology, or no optics at all with full reliance on the natural Lambertian (120 degree) light pattern emitted by the LEDs themselves. As will be understood by one of ordinary skill in the art, Lambertian reflectance is the property that defines an ideal "matte" or diffusely reflecting surface. The apparent brightness of a Lambertian surface to an observer is the same regardless of the observer's angle of view. However, the reliance solely on Lambertian light patterns may be too limiting in many instances and there are many applications where this range needs to be increased. Much of the current technology is evaluated on the basis of the total number of lumens and lumens per watt that an individual light fixture produces. However, an LED with no optics whatsoever has the highest lumens per watt efficiency. Therefore, lumen evaluation of a particular light fixture has very little benefit in deciding whether a particular light fixture is the best choice for a given lighting niche such as a parking lot, front line car dealership, sports field, tennis court, roadway, pathway, or just about any niche lighting application that requires an optical system which is directional and is specifically catered to that application.

When a light source is directed through reflective or refractive direction there is lumen loss based on the distance required to rebound off of a given reflective surface or loss based on the principles of refraction. Naturally, a desirous feature of any lighting system is to direct as much light as possible only where the light is needed and have as little light as possible outside the target zone. The best fixtures and optical systems require the least amount of units and electricity while still achieving the light level recommendations of the IES (Illuminating Engineer Society) for any given application. The IES light level recommendations for dozens of different lighting applications are used as a baseline for project light level design, safety, security, and crime prevention. The IES best practice recommendations for a given lighting applications are the standard for lighting design utilized by architects, engineers, contractors, municipalities, and end users to determine how many fixtures are required to best meet the IES recommendations on a functional basis as well as a potential legal basis based on a potential crime which could have been prevented if the proper light levels could have prevented the opportunity for the crime to occur.

Regarding commonly used refractive technology, such technology is reliant on plastic lenses which direct the light to the intended lighting zone. Most refractive technology has an individual lens which directs the light emitted from each individual LED. Some refractive lenses direct a small group of LEDs (array) placed in close proximity. Most all refractive technology is fixed and limited in nature and cannot be adjusted in the field or during assembly other than ninety degree increments. The distribution range of a fixture with a fixed refraction system has its range of light limited by the size of the lens and by the size of the refractive lens. LEDs are very small light sources measuring approximately three millimeters. The principals of refraction dictate that the further away from the light source the refractive element is the lower the output. The principals of refraction are limited in their application efficiency due to the physical constraints imposed by LED size with respect to refractor size. Refractive technology can also be glary.

In addition, many existing fixtures utilizing refractive technology have their refractive lenses protruding below the horizontal plane of the fixture. Often the protruding refractive lenses are visible above the horizontal plane of the fixture causing up-light which is environmentally undesirable as it causes light pollution. Additionally, the protruding refractive lenses below the horizontal plane of the fixture can be viewed undesirably at great distances beyond the property line of the project from any point lower than the fixture mounting height distracting drivers, pedestrians, and those living nearby with windows that face the project. Refractive lenses have additional drawbacks in that they have the potential for oxidation which limits the light pattern in future years and also lets less light out of the fixture causing the LED's to run hotter and depreciate at a higher rate. Sandblasting of the lenses is also a future concern along beaches and other open areas that see high winds. Sandblasting has the same negative effect on refractive lenses as oxidation. Plastic refractive lenses require chemicals to manufacturer and are toxic in nature.

Regarding reflector based technologies, hydro-formed or stamped technology using highly polished aluminum or plastic surfaces is a commonly used lighting technology. However, this technology is limited in its ability to meet the many different lighting patterns required for the many different lighting applications. Such reflective surfaces do not adjust to different mounting heights and fixture spacing. In addition, hydro-form technology is also an expensive manufacturing process in terms of tooling costs which become an obstruction to improvement.

Given the drawbacks of the current technological approaches using LEDs alone or in conjunction with either refractive or reflective components, there exists a need for an improved illumination system that facilitates a large variety of settings, may be provided as a retrofit kit, and allows for adjustments to both the directionality and intensity of light while more accurately targeting the zone of illumination.

SUMMARY OF THE INVENTION

In accordance with the principles of the present invention, a reflector based illumination system may be inserted into a housing and placed in communication with a power source to energize an internal light source to illuminate an exterior surface through an opening in the housing. In general terms, the reflector based illumination system comprises a mounting insert with at least one primary reflective surface and at least one circuit board having at least one light source. The reflector based illumination system further comprises at least one auxiliary reflector with an auxiliary reflective surface mounted within the housing at an angle to the primary reflective surface with both reflective surfaces being recessed from the opening of the housing. The light source may be placed in communication with the power source and energized to emit a first quantity of incident light toward the primary reflective surface, a second quantity of incident light toward the auxiliary reflective surface, and a third quantity of unobstructed light through the opening, with all three quantities cooperating to target and illuminate the exterior surface.

The present invention may also be embodied in an illumination system having one or more individual reflective free standing panels located about a housing in different configurations to provide the required foot candle levels at the lowest possible wattage. The panels are also field adjustable with a tool that can increase or decrease the vertical angles of illumination based on job site conditions. Each curved or bent panel simulating a curve can provide a large uniform vertical range of illumination from very high angles of illumination to low angles of illumination. At the same time the panels can be fixed on to the housing at different angles that define the desired horizontal range of the vertical angles so that light is doubly controlled in both horizontal and vertical angles and targeted at the lighting zone.

In at least one embodiment of the present invention, the light source is provided by LEDs.

In another aspect of the present invention, a plurality of LED-reflector assemblies are provided within the housing with the normal direction of at least one reflector being either parallel to or convergent with the normal direction of at least one other reflector.

In yet another aspect of the present invention, at least one side kick reflector is provided within the housing to direct light in more directions than provided by the primary reflective surface and auxiliary reflective surface.

Another feature of the present invention is the introduction of a lens covering the opening the housing through which light emitted by the light source may be directed downwardly onto a targeted area while preventing light from escaping in an upwardly direction.

Other aspects of the present invention allow for adjusting the reflective surfaces, particularly the auxiliary reflective surfaces and side kick or front kick reflector surfaces to accommodate different lighting configurations.

A reflector based illumination system provided in the form of a retrofit kit to use with conventional housings and power sources is also disclosed herein.

Methods of illuminating an area using a reflector based illumination system are also disclosed herein.

All of the embodiments summarized above are intended to be within the scope of the invention herein disclosed. However, despite the discussion of certain embodiments herein, only the appended claims (and not the present summary) are intended to define the invention. The summarized embodiments, and other embodiments and aspects of the present invention, will become readily apparent to those skilled in the art from the following detailed description of the preferred embodiments having reference to the attached figures, the invention not being limited to any particular embodiment(s) disclosed.

BRIEF DESCRIPTION OF THE DRAWINGS

FIG. 14A depicts a summary table of photometric readings taken about an exemplary tennis court.

DETAILED DESCRIPTION OF THE PREFERRED EMBODIMENTS

Figure 1:
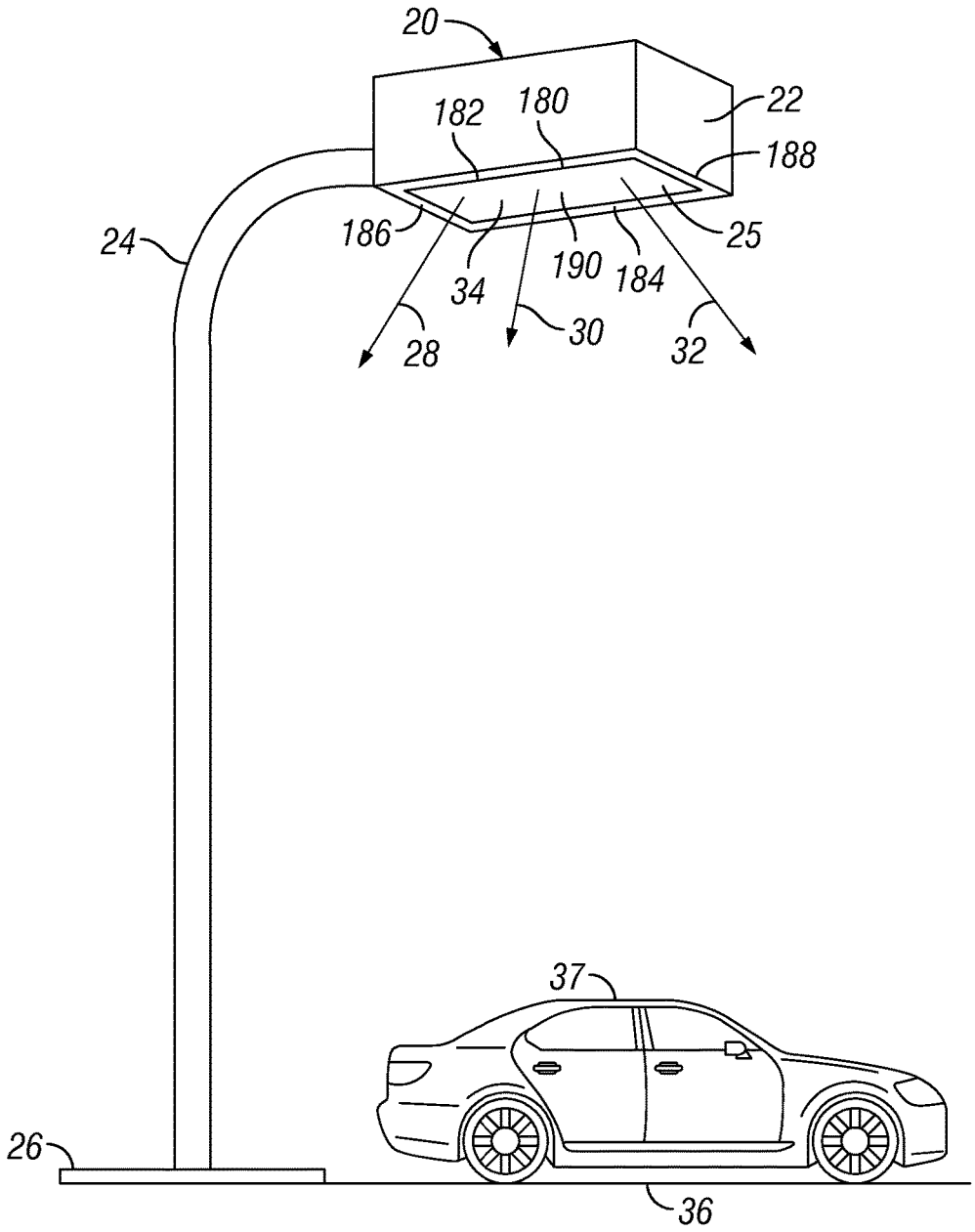
FIG. 1 is a perspective view of an exemplary first embodiment of a reflector based illumination system, used in an outdoor setting, in accordance with the principles of the present invention.

Referring now to FIGS. 1-6, an exemplary embodiment of a reflector based illumination system, generally designated 20, is provided with an external housing 22 constructed to be mounted to a lamp or other support post 24 projecting from an anchoring structure such as a base plate 26 and situated in an outdoor setting such as a parking lot, auto dealer, stadium, athletic or entertainment venue, tennis court, or other outdoor setting typically requiring elevated lighting structures to direct light as indicated by rays 28, 30, and 32 through a transparent or translucent lens 34 or light filter, if used, and onto a surface 36 or object such as a car 37 located exterior to the housing. It will be appreciated that the housing 22 of the illumination system 20 may be connected to the support post or pole 24 using conventional means as would be understood by one of ordinary skill in the art.

With continuing reference to FIGS. 1-6, in addition to the external housing 22, the illumination system 20 further includes an internal housing base, backing, or chassis 38 and a reflector placement insert or liner 40 (also referred to as the top reflector herein) having a set of four LED assembly apertures or retention slots 42, 44, 46, 48 (FIG. 2) constructed to receive four corresponding LED-reflector subassemblies 50, 52, 54, 56 (FIGS. 3-6).

Figure 2:
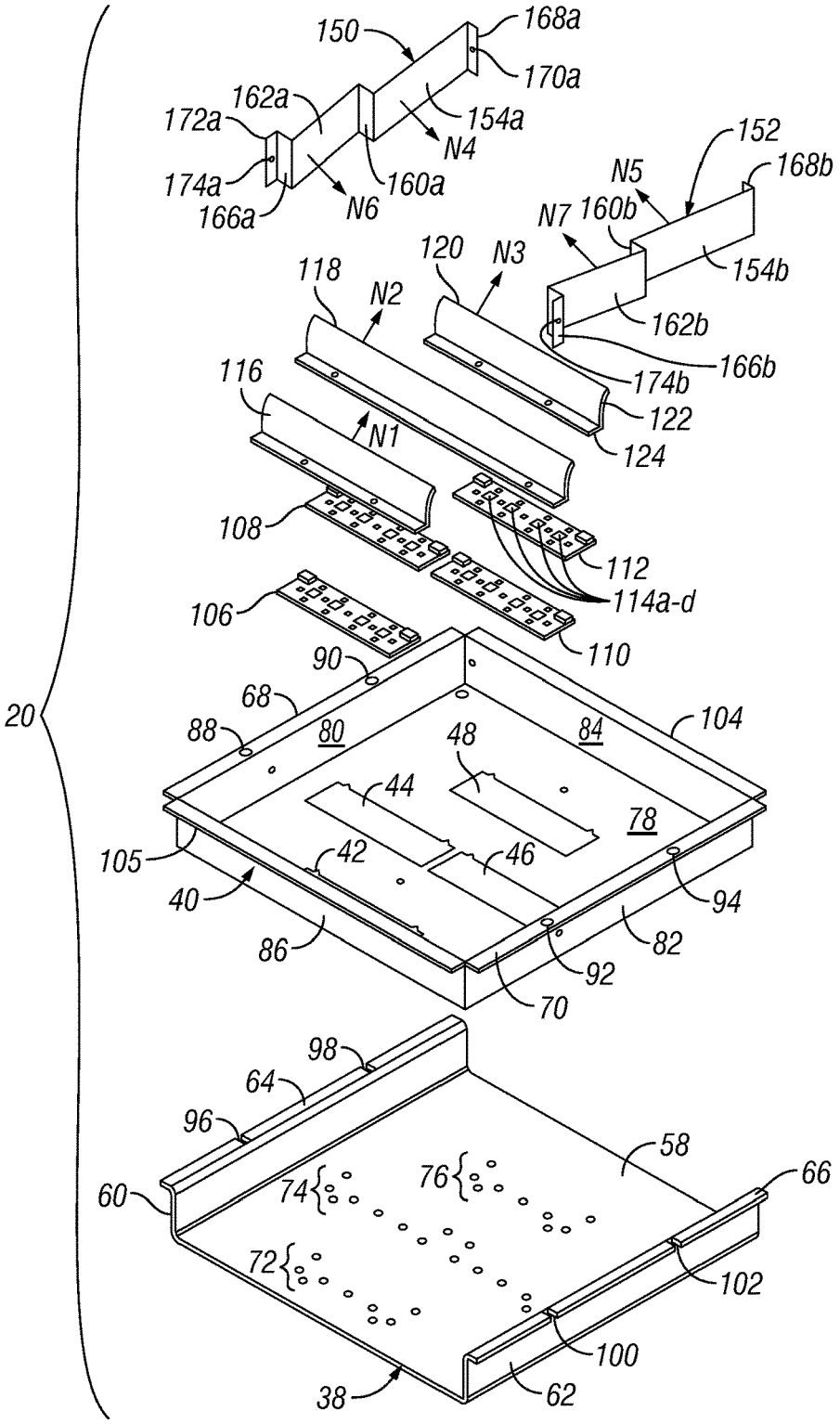
FIG. 2 is an exploded view of a four bar reflector based illumination system presented as a retrofit kit assembly for insertion into a housing.
Figure 3:
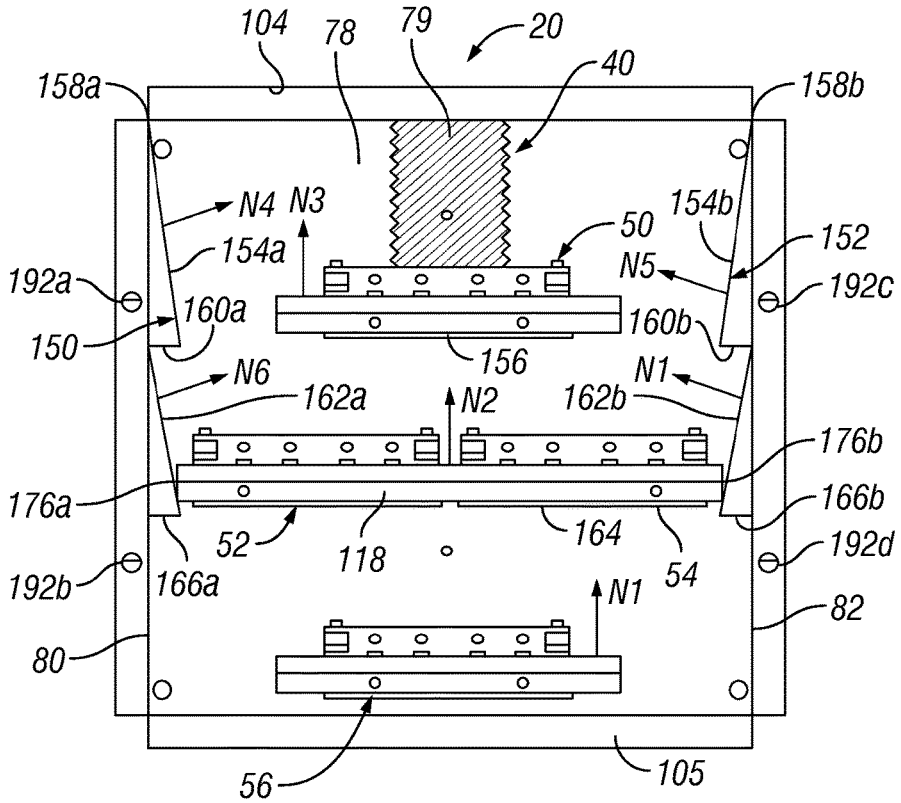
FIG. 3 is an assembled bottom view of the four bar illumination system of FIG. 2.

Still referring to FIGS. 2-3, in this exemplary embodiment, the chassis 38 includes a planar central section 58 and two opposing upwardly turned sidewalls 60, 62 to form a channel shaped base section of the illumination system 20. Each sidewall 60, 62 includes an outwardly turned flange 64, 66, respectively, for coupling to a corresponding flange 68, 70 on the liner 40. Within the central section 58 are a set of rear connection apertures 72, intermediate connection apertures 74, and forward connection apertures 76 for receiving fastening hardware such as screws, bolts, clips, adhesives, welds, snaps, or other suitable fastener to secure the LED-reflector subassemblies 50, 52, 54, 56 (FIGS. 3-6) to the insert 40.

With continued reference to FIGS. 2-3, the insert 40 (also referred herein shell or liner) includes a recessed planar central section 78 of which at least a portion forms a primary reflective surface 79 surrounded by upwardly projecting left, right, front, and back sidewalls, 80, 82, 84, 86, respectively. The left flange 68 extends outwardly from the upturned left sidewall 80 while the right flange 70 extends outwardly from the upturned right sidewall 82. Each flange 68, 70 includes a set of two apertures 88, 90 and 92, 94, respectively. During assembly, the insert 40 may be placed atop the base 38 with the apertures 88, 90 of the left flange 68 aligned with two corresponding slots 96, 98 of the left flange 64 and the apertures 92, 94 of the right flange 70 aligned with two corresponding slots 100, 102 of the right flange 66 and then fastened together using conventional fasteners such as screws, rivets, clips, snaps, buttons, quick release couplings, or other suitable fasteners, including magnets and hook and loop fasteners. This aligns the LED-reflector assembly apertures 42, 44, 46, 48 with the respective connection aperture sets 72, 74, 76, respectively. In this exemplary embodiment, the intermediate connection apertures accommodate both sets of intermediate LED-reflector subassemblies 52, 54, including a common reflector 118. The insert 40 may also have a front flange 104 and rear flange 105 projecting outwardly from their respective sidewalls 84, 86.

It will be appreciated that the planar central sections 58 and 78 may nest directly against one another when assembled or may be spaced apart to accommodate heat sinks, wiring harnesses, spacers, power sources, transformers, or other illumination or structural housing components. It will further be appreciated that the illumination system may include the housing 22, chassis 38, and insert 40 along with all their respective components, or may be provided with just the chassis and insert for insertion into a pre-existing housing as part of a retrofit kit. In addition, while the chassis 38 provides a structural backing and anchor point for the liner 40, the two components may be integrated into a single piece insert as well.

In this first exemplary embodiment (four bar version) with four LED-reflector assemblies 50, 52, 54, 56 (FIG. 3), with 52, 54 sharing a common reflector 118, a rear printed circuit board (PCB) 106 may be aligned with and nested atop or within the rear aperture 42 of the insert 40. Similarly, left and right PCBs 108, 110 are aligned with and nested atop or within the left and right intermediate apertures 44, 46, respectively. Lastly, a forward PCB 112 is aligned with and nested atop or within the front aperture 48 of the insert 40. In this exemplary embodiment, each PCB is constructed identically and includes an LED array of four distinct LEDs such as indicated by reference numerals 114*a-d* on PCB 112 as shown in FIG. 2.

Referring now to FIGS. 2-6, secured to each PCB 106, 108, 110, and 112, is a curved (or arcuate or semi-parabolic) reflector 116, 118, 120. In this exemplary embodiment, each reflector 116, 118, 120 (also referred to as reflector panel or fin or top kick reflector) has a constant radius of curvature measured from the bottom edge to the top edge of each reflector and an arc length of 1.25" to 6". It will be appreciated that such reflector panel characteristics are meant to be exemplary and not limiting in any manner. The curvature or profile of the reflector surface may be constant, variable, a curve approximated using one or more faceted adjacent sections, faceted, or encompass a combination of curved, compound curved and stepped, faceted, or other flat surfaces. The reflective surface or side 126 (FIGS. 4-5) facing the LEDs is concave while the opposing rear surface 140 (FIG. 6) is convex relative to the placement of the LED array. In this exemplary embodiment, the curved reflector 116 is secured to PCB 106 and the curved reflector 120 is secured to the PCB 112. However, the common curved reflector 118 spans both intermediate PCBs 108, 110 and is secured to both PCBs. Each reflector is constructed the same, except that the intermediate reflector 118 is wider than the rear and front reflectors 116, 120, respectively. It will be understood that the LED-reflector assemblies are depicted in an inverted position in FIGS. 2-6 as these are generally bottom views of such components. However, the housing may be mounted in all directions depending on where the target zone of illumination is located relative to the housing placement.

With reference to FIGS. 2-6, using reflector 120 as an example, each reflector has a curved section 122 extending from a rearwardly projecting attachment flange 124. The attachment flange 124 includes a set of fastener apertures (covered by screws 148*a*, 148*b* of FIG. 6) for aligning with similar apertures in the corresponding PCB 106 through which a fastener 148*a*, 148*b* may be inserted to secure the PCB with LED array and reflector to the base 38. In such manner, all four PCBs and reflector assemblies may be secured to the base during assembly. While such connections may fix the reflector in place relative to the LED array, it will also be appreciated that elongated slots, tracks, or rails may be used as fastener apertures for adjusting the position of each reflector 116, 118, 120 relative to the LED arrays. Such reflector adjustments includes proximity to the LED arrays, angle relative to the LED arrays, and height relative to the LED arrays. In addition, the PCBs may be constructed to adjust relative to either a fixed or adjustable reflector. Alternatively, instead of threaded fasteners, clips, adhesives, or welds, the PCBs or LED-reflector subassemblies may simply be snapped or force fit into the openings 42, 44, 46, 48. The top kick reflectors 116, 118, and 120 may also be coupled or connected using suitable adhesives, welds, or other suitable fasteners. Alternative mounting positions may be provided to adjust or vary the position of the primary reflective surface 79 of the top reflector 78 as well Referring to FIG. 2, in this exemplary configuration, the normal directions, as measured form the top edge of each reflector 116, 118, and 120 and indicated as N1, N2, and N3, respectively as shown in FIG. 2 are aligned or parallel to one another and generally projecting toward the front sidewall 84 of the insert 40.

Figure 4:
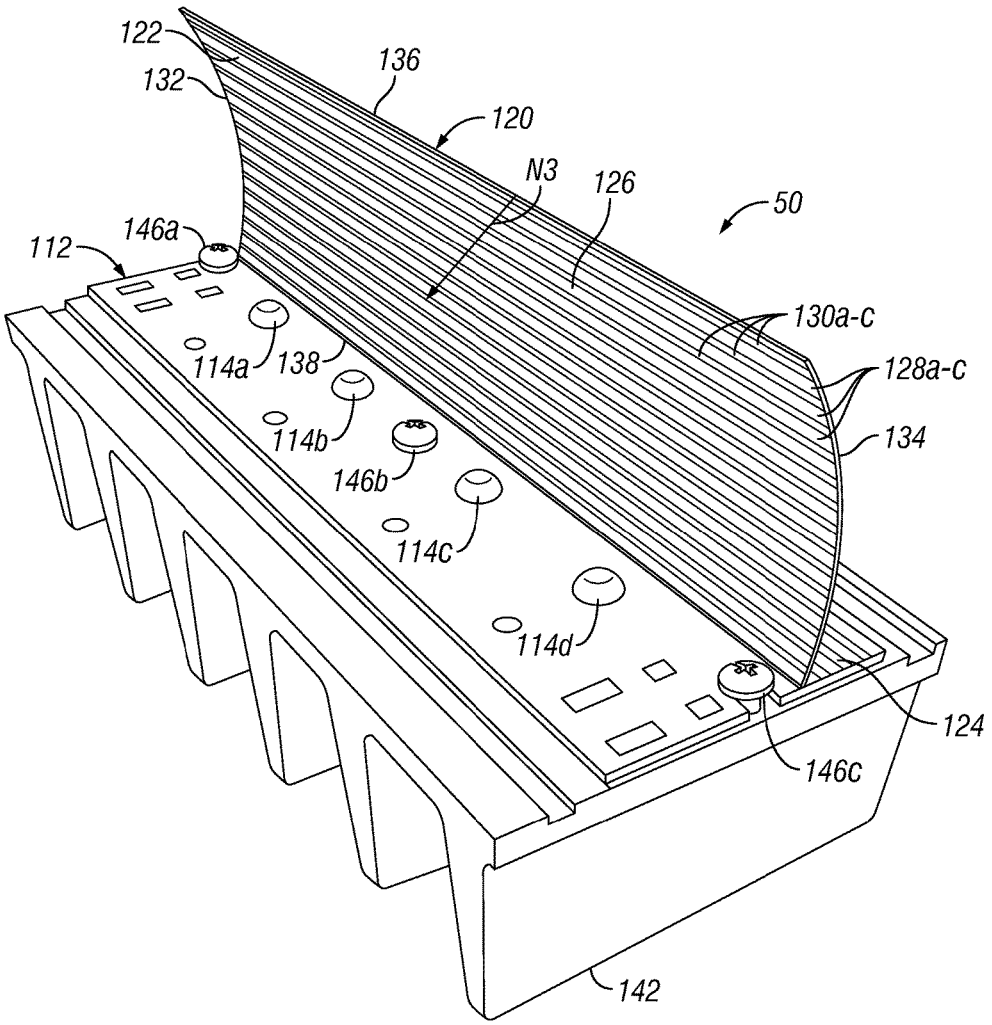
FIG. 4 is a front and right side perspective view of a single LED-reflector assembly unit.
Figure 5:
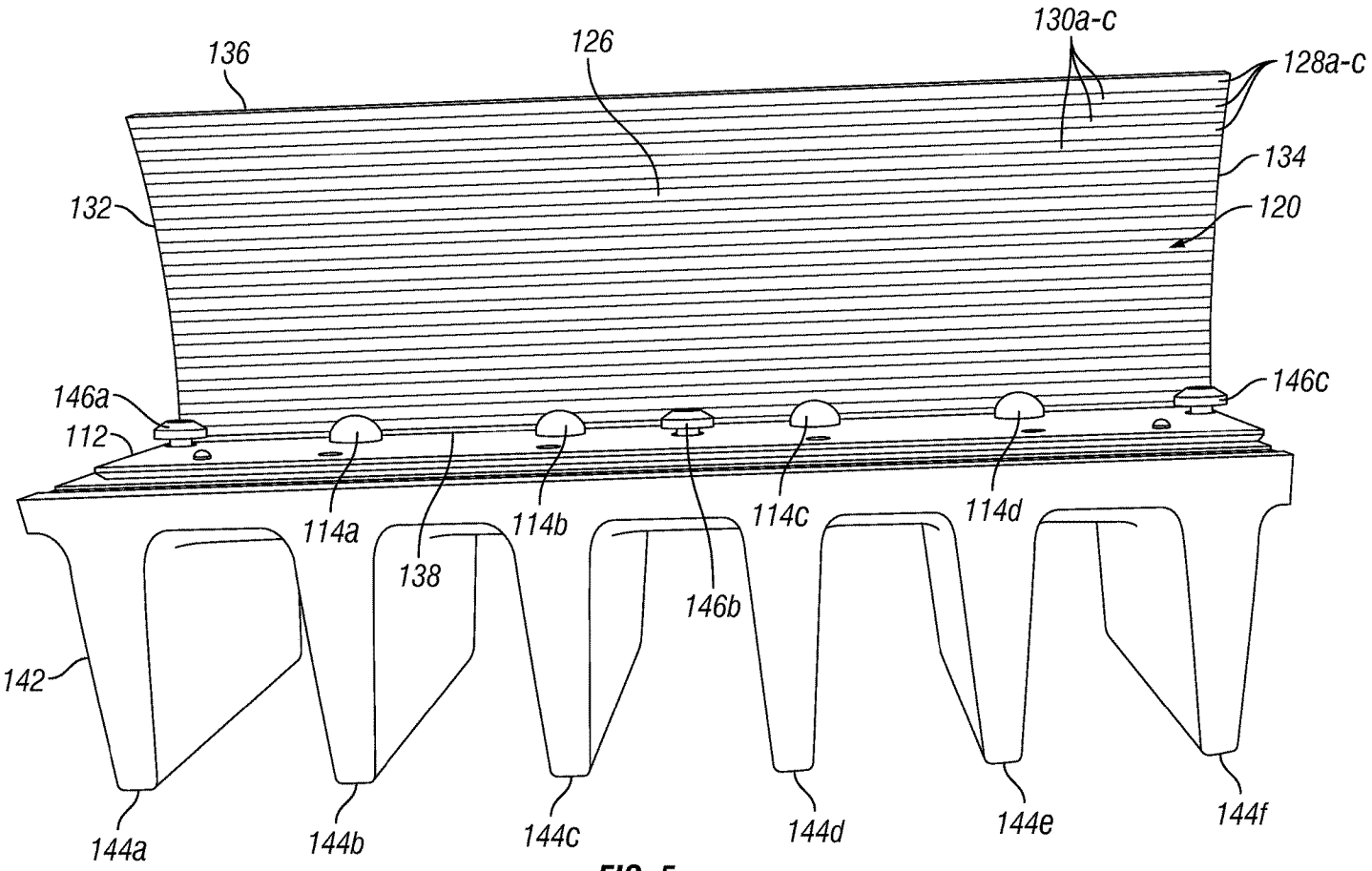
FIG. 5 is front view of the unit of FIG. 4.
Figure 6:
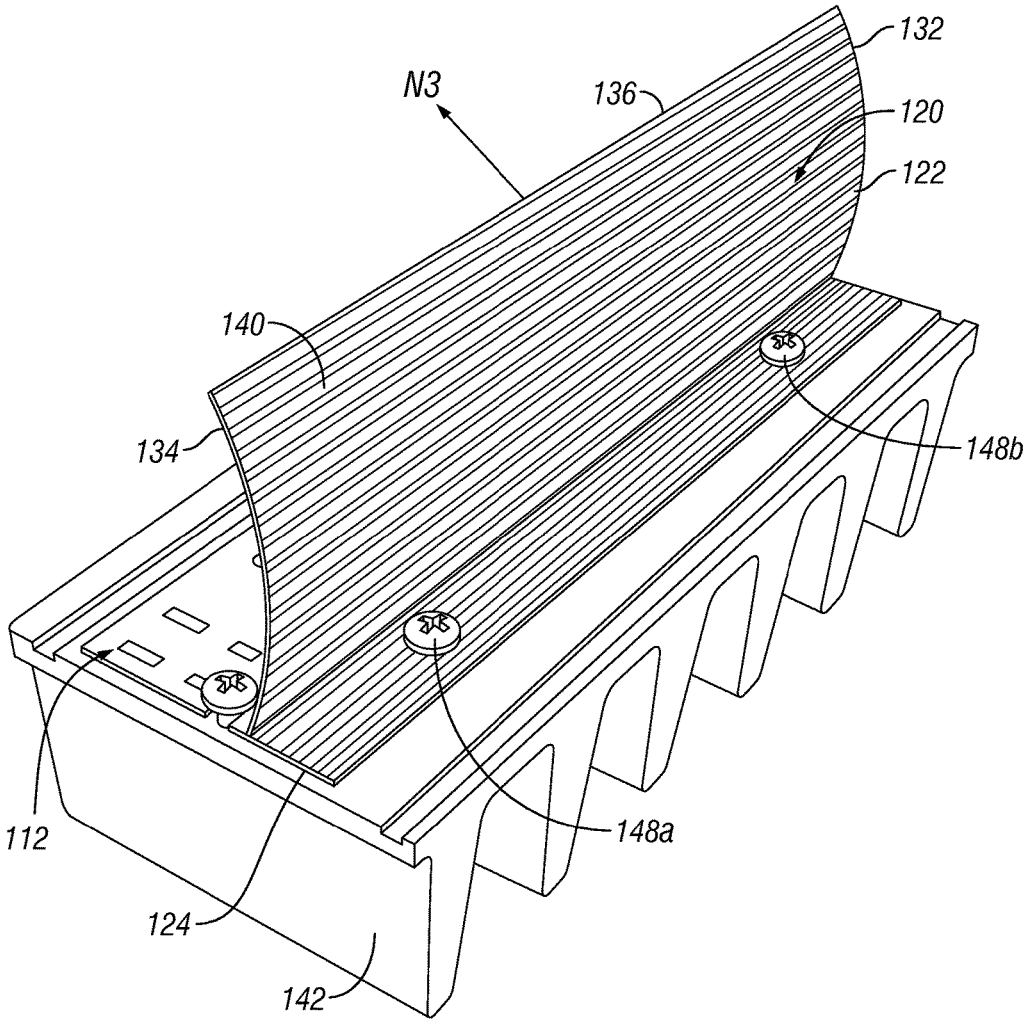
FIG. 6 is a rear and right side perspective view of the unit of FIG. 4.

Turning now to FIGS. 4-6, the LED-reflector assemblies 50, 52, 54, 56 will now be described in more detail using the front PCB 112 and reflector 120 as an example of an LED-reflector subassembly. As shown in FIG. 4, the PCB 112 includes an LED array of four LEDs 114*a-d* disposed before the forward facing surface 126 of the reflector 120. This forward facing surface 126 provides an auxiliary reflective region comprised of alternating stripes of highly polished regions 128*a-c* and less polished regions 130*a-c*. The stripes span from the left edge 132 to the right edge 134 of the reflector 120 and from the top edge 136 to the bottom edge 138 of the reflector in this exemplary embodiment. One such suitable material is available from the Aluminum Coil Anodizing Corporation (ACA) of Streamwood, Ill. under the product ID 4250OE/BF Super UltraBrite 95. For this exemplary material, each stripe has a thickness of 1-2 mm, although this is not meant to be limiting in any manner. The combined total reflectance of the highly polished regions 128*a-c* and the less polished regions 130*a-c* is 95% minimum while the distinctness of image is 96% minimum, and the specular reflectance is 84% minimum. In this description, the term low gloss or low polish is relative to the term high gloss or high polish in that the high gloss sections simply have a higher gloss rating relative to the low gloss sections. Low gloss may include polished sections (with a lower gloss rating), or unpolished or matte surfaces. The technique for forming the alternating high gloss/low gloss patterns is well known in the industry and such material is available from the Aluminum Coil Anodizing Corporation of Streamwood, Ill. It will be appreciated that the entire surface 126 facing the LED array 114*a-d* may be high gloss without the alternating stripes as well or may provide an entire unpolished or matte surface for a more diffuse reflection pattern. In addition, the low gloss stripes may be flat or matte or even offer a light absorbing surface. In addition to stripes, other patterns may be used as well depending on the desired reflective characteristics of the fin surface 126. As shown in FIGS. 4 and 6, the reflective surface pattern is provided on both the surface 126 facing the LED array 114*a-d* and the rear surface 140 of the reflector 120. While in this exemplary embodiment, the reflector is provided with a striped pattern, the reflector also functions without the stripes and may be provided with a diffused material and if the angle was perfect, high polished glossy materials or surfaces as well.

In this exemplary embodiment, the LED-reflector assembly (112, 120) includes an optional heat sink 142 (FIGS. 4-6) that also serves as a base support or anchor point for the LED-reflector assembly (112, 120). The heat sink includes a set of six spaced apart fins 144*a-f* or legs for allowing air to circulate near the LED array 114*a-c* and transmit heat from the PCB 112 toward the insert 40 and base 38. Like the PCBs and reflector assemblies, the LED-reflector assembly with PCB and LED array, reflector, and heat sink may be snapped or press fit into the LED-reflector assembly apertures 42, 44, 46, 48 or secured using a suitable fastener, adhesive, or weld. The PCB 112 is fastened to the heat sink using a set of three screws 146*a-c* through apertures in the PCB and underlying heat sink. Similarly, the reflector 120 may be fastened to the heat sink using two more screws 148*a-b* (FIG. 6).

Referring back to FIGS. 2-3, in addition to the primary reflective surface 79 and four LED-reflector assemblies 50, 52, 54, 56, each sidewall 80, 82 of the insert 40 may include an optional a side kicker (reflector) generally designated 150, 152, respectively. The side kicker reflectors 150, 152 are mounted along the sides of the top kickers 50, 52, 54, 56 and inside the side walls 80, 82 of the top reflector 40. In this exemplary embodiment, the side kickers are constructed in identical fashion but mounted as mirror images to one another about a center line passing through the front (leading) flange 104 and rear (trailing) flange 105 of the primary reflector 40 as viewed in FIG. 3. As shown in FIG. 3, the side kickers 150, 152 have a stepped profile with a first section 154*a*, 154*b* spanning the distance from the interior leading edge of the front flange 104 of the primary reflector 40 to the approximately the trailing edge 156 base of the first top kicker reflector 50 and angled inwardly from the outer leading edges 158*a*, 158*b* where it meets the respective left and right side walls 80, 82 of the top reflector 40. From that region, each side reflector 150, 152 forms a first bend 160*a*, 160*b* that bends outwardly to meet the respective side walls 80, 82 of the top reflector 40. A second planar section 162*a*, 162*b* projects inwardly and spans the distance from the first bends 160*a*, 160*b* to base of the intermediate top kicker 164. From there, each side reflector 150, 152 forms a second bend 166*a*, 166*b* that bends outwardly to meet the adjacent side wall 80, 82 of the top reflector 40. Each side kick reflector 150, 152 further includes a front fastening tab 168*a*, 168*b* extending inwardly from the leading edge of the first section 154*a*, 154*b* including an aperture 170*a* (right side aperture not shown) and a rear fastening tab 172*a*, 172*b* extending rearwardly from the second bend 160*a*, 160*b* that also includes an aperture 174*a*, 174*b* for securing the side kicker reflector to the interior surface of the adjacent reflector side wall 80, 82. The side reflectors cooperate with the LED arrays to provide a long range illumination pattern while the short range LED array is not adjacent a side kicker reflector. In this exemplary embodiment, the inner edge of the second bend 166*a*, 166*b* of each side kicker 150, 152 is proximate the adjacent outer edge 176*a*, 176*b* of the intermediate top kicker 118. When the side kickers are installed (FIG. 3), the normal direction N4, N5 (as measured from the first sections 154*a*, 154*b* in FIG. 2) of each side kick reflector 150, 152 converge toward one another and also intersect the normal directions N3 of the forward top kick reflector 120. The normal directions N6, N7 (as measured from the second sections 162*a*, 162*b* in FIG. 2) of each side kick reflectors 150, 152 also converge toward one another and intersect the normal directions of the intermediate top kick reflector 118.

As shown in FIG. 3, there are two long range LED-reflector subassemblies 50 and 52, 54 combined and one short range LED-reflector subassembly 56, each having their own LED array. The short range LED array of LED-reflector subassembly 56 is for projecting light a distance of zero to two mounting heights in a forward and downward direction as well as horizontal direction while the long range LED arrays of LED-reflectors subassemblies 50 and 52, 54 combined are for projecting light a distance of two to five mounting heights in a forward and downward direction as well as horizontal direction in this exemplary embodiment. As shown in FIGS. 2-3, the convex facing surfaces (such as 126 in FIGS. 4-5) of the curved reflectors 116, 118, and 120 all face in the same direction toward the front wall 84 of the primary reflector 40. The side kick reflectors 150, 152 assist in directing light escaping laterally from the LED arrays in an expanded radius toward side walls 80 and 82 by reflecting the light waves or rays back across the light paths created by the reflectors 116, 118, and 120. It will be appreciated that the location of the opening 25 of the housing 22 and position of the set of recessed reflective surfaces 79, 116, 118, 120, 150, and 152 ensure no light is cast upwardly (assuming a downward configuration as in FIG. 1 and non-protruding lens 34) thus concentrating the maximum amount of light on the underlying surface 36 or object 37 (FIG. 1). This helps to reduce light pollution when viewed from above the external housing 22. In many illumination systems constructed in accordance with the principle of the present invention, the majority of panels are angled to throw at a high angle. When this occurs the curve of the reflector covers the diode and prevents light from being able to cast straight down. In such cases, generally one panel in the multiple panel configurations is devoted to lighting downwards, such as by omitting a reflector, so that a shadow does not occur directly below the luminaire.

Figure 7:
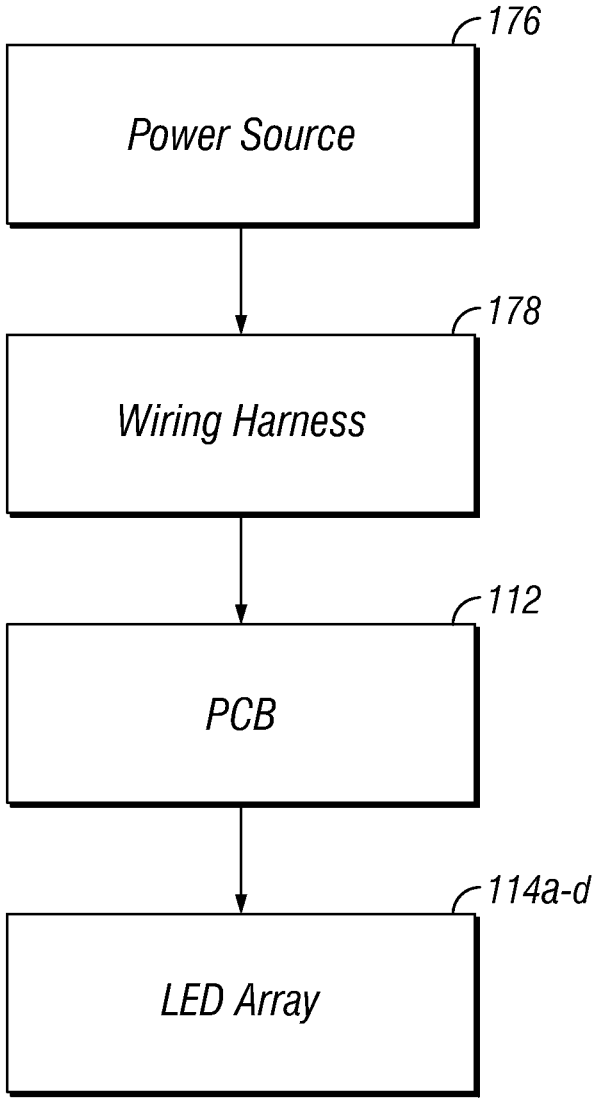
FIG. 7 is a simple block diagram of the electrical path of the illumination system.

Referring now to FIG. 7, the LED array 114*a*-*d* on the PCB 112 may be connected to a power source 176 by a wiring harness 178 as would be understood by one of ordinary skill in the art familiar with supplying power to lighting sources. This electrical connection from the LED arrays to the power source facilitates the installation of either an entire illumination system with housing onto a support pole 24 or in the form of a retrofit kit for insertion into a pre-existing housing 22. With the PCBs placed in communication with the power source, either directly or via a wiring harness or other intermediate components, one or more LEDs of each connected LED array such as LED array 114*a*-*d* may be energized to emit light. Other electronic components such as transformers and ballasts may be used as well in the electrical path.

Referring now to FIG. 1, the lens 34 interposed between the LED arrays (such as 114*a*-*d* of FIG. 2) of the LED-reflector assemblies 50, 52, 54, 56 and the lowermost edge 180 of the external housing 22 may be in the form of a transparent or translucent planar surface may be secured to the flanges 68, 70 as well or simply sandwiched between inwardly turned flanges 182, 184, 186, 188 (FIG. 1) of the external housing 22 and the base 38 and insert 40 assembly. The lens provides a lowermost surface 190 as shown in FIG. 1 and is disposed in a spaced apart relationship from the primary reflective surface 79 and through which light emitted by the LED arrays is allowed to pass. While the lens 34 is preferred for protecting the LED-reflector assemblies 50, 52, 54, 56, it is an optional component. The lens may also provide alternative lighting effects, glare reduction, filtering, or diffusive lighting characteristics. It is also preferred to use a lens that does not project below the lowermost extent of the housing to reduce light being cast in undesirable directions such as an upward direction to reduce light pollution when viewed from above.

Figure 8:
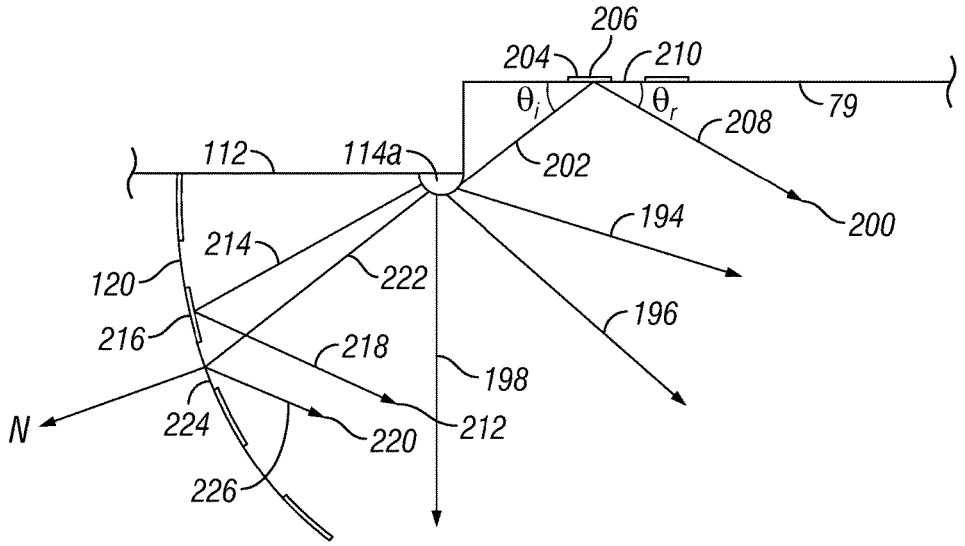
FIG. 8 is an illustrative exemplary ray diagram of a light source emitting light rays adjacent an exemplary reflector set.

Referring now to FIG. 8, an illustrative light ray diagram is shown using an exemplary LED 114*a* projecting downwardly from a PCB 112 placed adjacent to curved reflector 120 and the top reflective surface 79. A number of different light rays are shown issuing from the LED 114*a*. Three light rays 194, 196, 198 projecting from the LED 114*a* are unobstructed or unreflected, that is, these rays do not encounter a reflective surface. A fourth representative light ray 200 includes a first section 202 (the incident ray) issuing from the LED 114*a* to encounter a planar polished section 204 of the primary reflective surface 79 at a strike point 206 and is then reflected as indicated by section 208 (the reflected ray) wherein the angle of incidence (theta sub i) equals the angle of reflection (theta sub r). An unpolished section 210 is adjacent the polished section 204 on the primary reflective surface 79 and would receive light rays as well and present a more diffuse reflective pattern relative to the more specular pattern produced by the polished section 204.

With continued reference to FIG. 8, another illustrative light ray 212 includes a first section 214 (incident ray) projecting from the LED 114*a* to strike a curved polished section 216 and then reflect away as indicated by section 218 (reflected ray). The last illustrative light ray 220 includes a first section 222 (incident ray) projecting from the LED 114*a* to strike an unpolished section 224 and reflect as indicated by section 226 (reflected ray). It will be appreciated that both light rays 218, 220 encountering the curved reflector will intersect with other unobstructed or unreflected light rays issuing from the LED 114*a* such as light ray 198. In addition, the intensity of the light ray 212 reflecting off the polished section 216 will be greater than the intensity of the light ray 220 reflecting off the unpolished section 224. In some instances, depending on the characteristics of the unpolished sections, very little light will reflect. On the other hand, if the entire surface of the reflector 78 or 120 is highly polished, then the light intensity will vary accordingly. It will be appreciated that the lines or stripes contribute to a smoother light pattern and tend to forgive the angle of manufacture or field adjustment.

The alternating stripes of high gloss 128*a-c* (FIG. 4) and low gloss or matte sections (130*a-c* (FIG. 4) may both be smooth or the low gloss sections may be rough or textured to alter the amount of light reflected. It will be appreciated that the high gloss sections approach a specular reflection while the low gloss or matte sections approach a more diffuse reflection. These alternating sections create a mixture of specular and diffuse reflection with the specular reflections providing more of the light source while the diffuse reflections reveal more of the reflective surface. The unpolished, matte, or lower gloss sections produce more diffuse reflections which tends to reflect light in all directions. In contrast, the high gloss sections tend to provide more specular reflections of the incident light in a more definite direction. The combination of specular and diffuse reflections in conjunction with the reflective surfaces 79, 116, 118, 120, 150, and 152 cooperate to focus the light toward a targeted zone of illumination (36 or 37 in FIG. 1 for example) and increase the intensity of the light resulting in a greater illuminance reading at the surface to be illuminated. By incorporating a set of angled and curved reflective surfaces, the emitted light may be more directly targeted at the preferred illumination surface this reducing the amount of wasted light. This results in an increased illuminance taken at a distance from the light source as will be described further below.

Materials:

Most of the components such as the housing 22, chassis 38, and insert 40 are constructed of metal such as aluminum and may be stamped, pressed, or formed into their respective shapes. The LED circuit boards are available from a multitude of PCB board manufacturers. The reflectors are preferably made of aluminum but other materials such as metal alloys and plastics may be used. The thickness of the material is typically but not limited to 0.025" to 0.040" inch thickness, with the striping pattern as made available from Aluminum Coil Anodizing Corporation (ACA) of Streamwood, Ill. One such suitable material available from ACA is sold under product ID 4250OE/BF Super UltraBrite 85. To shape the reflectors 116, 118, 120 (or comparable components in other embodiments), the reflectors may be stamped out and bent to form the curved portion 122 or fin and attachment flange 124 portion, using reflector 120 (FIGS. 4-6) for example. A press or punch may be used to form the fastener apertures. Support poles are conventional to secure the illumination systems 20 including the housings 22. Conventional power sources may be used to energize the light sources, such as the LEDs.

Figure 9:
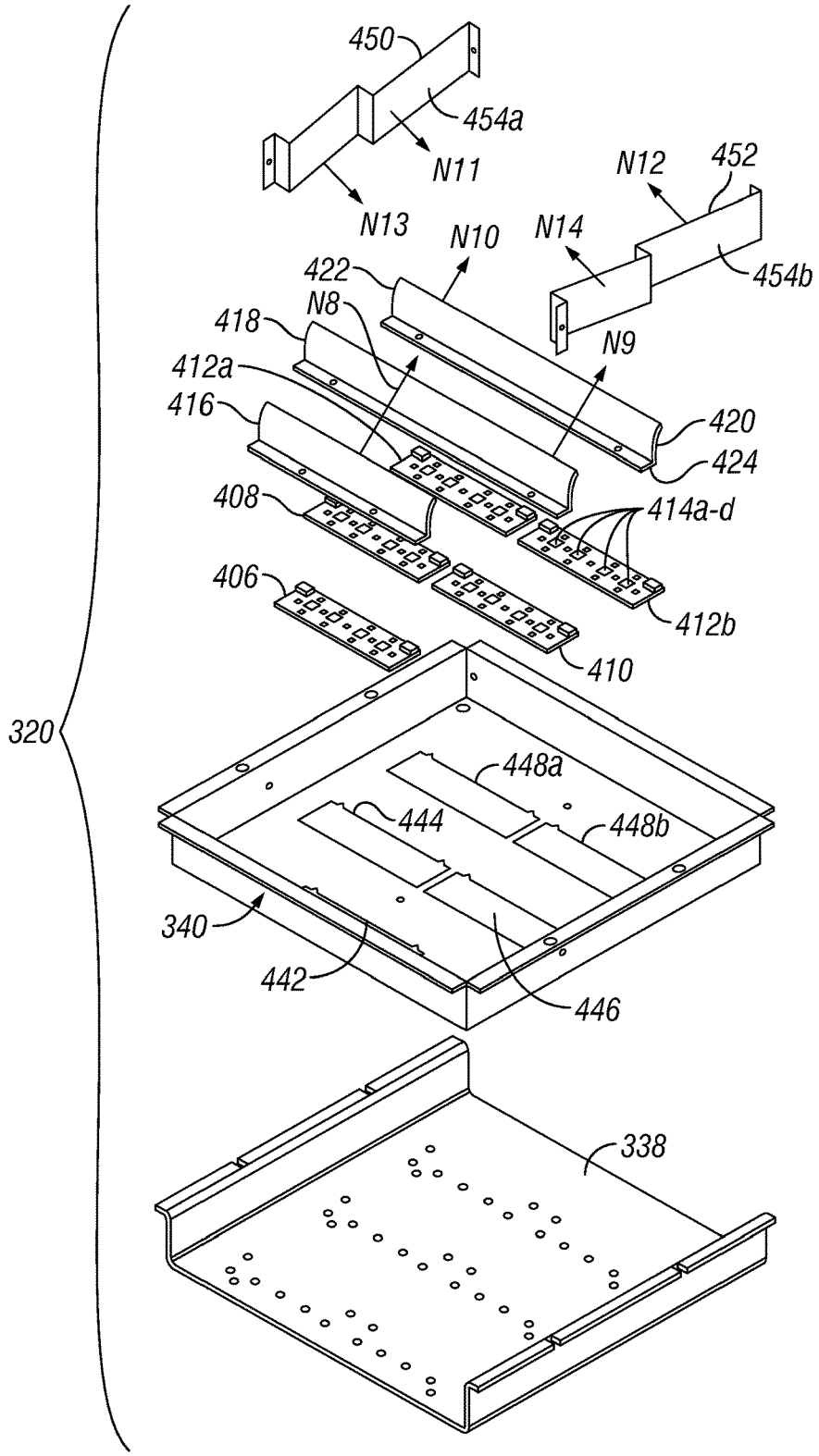
FIG. 9 is a similar view to FIG. 2 for a five bar reflector based illumination system.
Figure 10:
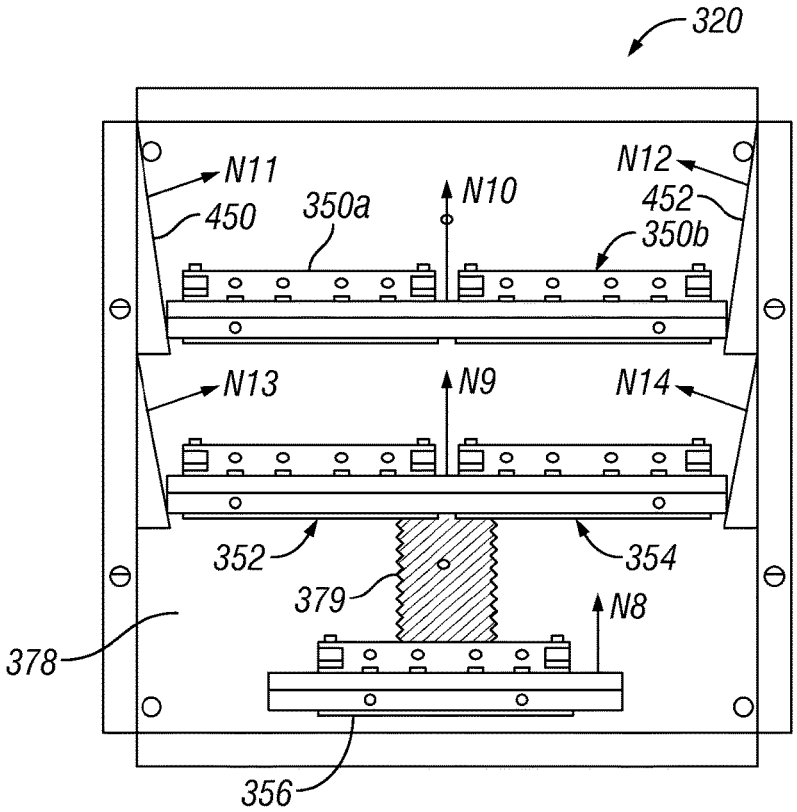
FIG. 10 is an assembled bottom view of the five bar illumination device of FIG. 9.

Alternative Embodiments:

Turning now to FIGS. 9-10 wherein like components are like numbered, a five bar reflector unit, generally designated 320 may be used to provide alternative lighting characteristics. As with the prior embodiment, the five bar reflector unit includes a chassis 338 and a primary reflector or insert 340. In this exemplary embodiment, however, there are five PCB apertures 442, 444, 446, 448*a*, 448*b* instead of four. More specifically, there is one rear aperture 442, two intermediate apertures 444, 446, and two forward apertures 448*a*, 448*b*. Each aperture is constructed to receive an LED-reflector assembly 350*a*, 350*b*, 352, 354, and 356. With the rear aperture 442 receiving a single PCB and reflector unit 356, the intermediate apertures 444, 446 receiving two PCBs 408, 410, respectively, sharing a common intermediate reflector 418, and the two forward apertures 448*a*, 448*b* receiving two PCBs 412*a*, 412*b*, respectively, also with a common forward reflector 420. A pair of side kick reflectors 450, 452 is provided as with the embodiment shown in FIGS. 2-3. The main difference is that the outer edges of the forward reflector 420 also extends into contact with the first planar section 454*a*, 454*b* of each side kick reflector. Each PCB-reflector assembly 350*a*, 350*b*, 352, 354, 356 includes an LED array such as that indicated by reference numeral 414*a-d* of PCB 412*b*. In addition, in this illumination system 320, the rear PCB-reflector assembly 356 has short range capability while both the intermediate PCB-reflector assembly 352, 354 combined and forward PCB-reflector assembly 350*a*, 350*b* combined have long range capability. Short and long range have a similar meaning as described above. In this embodiment, the normal directions N8, N9, N10 of each LED-reflector assembly are parallel to one another and do not intersect while the normal directions N11, N12, N13, N14 of the side kicker reflectors 450, 452 converge with their counterparts and intersect the top kick reflector normal directions N8, N9, and N10.

Figure 11:
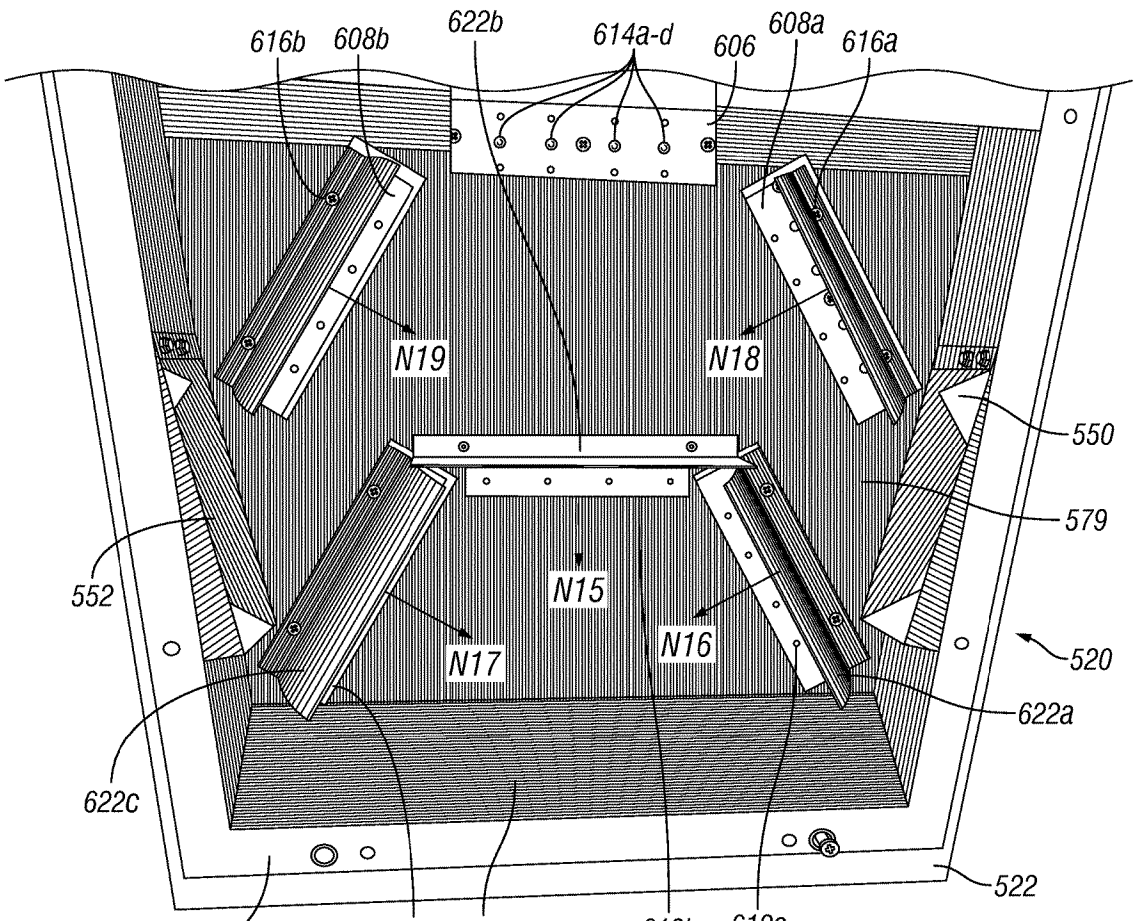
FIG. 11 is a partial cutaway of an assembled bottom view of another alternative reflector arrangement.

Referring now to FIG. 11, wherein like components are like numbered, an alternative five bar reflector unit in assembled form as viewed from below and generally designated 520 may be used to provide alternative lighting characteristics (target, direction, intensity, illuminance) as well. In this exemplary embodiment, there is a primary reflective surface 579, a forward angled planar reflector 581, and left and right opposing side kicker reflectors 550, 552. In addition, a forward set of top kicker reflectors 622*a*, 622*b*, and 622*c* are provided with the normal direction N15 of the center top kicker reflector pointing toward the front of the housing 522 while the normal directions N16, N17 of the left and right forward top kicker reflectors 622*a*, 622*c*, respectively, converging on one another and intersecting the middle normal N15. Similarly, the reflective surfaces of each of the rearward reflectors 616*a*, 616*b* are angled toward one another as well to cause their normal directions N18, N19 to converge at a point interior to both reflectors. Another difference is that the forward central top kick reflector 6*aab* is not pair with a PCB and LED array but spans the gap between the left and right forward reflectors 622*a*, 622*c*. Another modification is the provision of a single PCB 606 with LED array of four LEDs 614*a-d* is disposed in the gap between the rearward reflectors 616*a*, 616*b*. In contrast, the left and right top kick reflectors 622*a*, 622*c* are paired the PCBs 612*a*, 612*b* having LED arrays. The left and right rear top kick reflectors 616, 616*b* are also paired with PCBs 608*a*, 608*b* with LED arrays. Forward facing reflector 622*b* is paired with PCB 612*c*. By varying the positions of the top kick reflectors and pairing or not pairing with an LED array, various illumination characteristics (such as targeted area, zone of illumination, intensity, and luminance) may be obtained. In this example, the five bar reflector unit 520 throws light in four different primary directions including a forward direction from forward facing reflector 622*b* and PCB 612*b* and thrown straight down to remove shadows underneath the fixture from PCB 606. Moreover, light is also thrown or cast in the direction of normals N18 and N16 from reflectors 616*a*, 622*a*, respectively, and thrown in the direction of normal N19 and N17 from reflectors 616*b*, 622*c*, respectively providing left and right directional throws of light as well.

Figure 15:
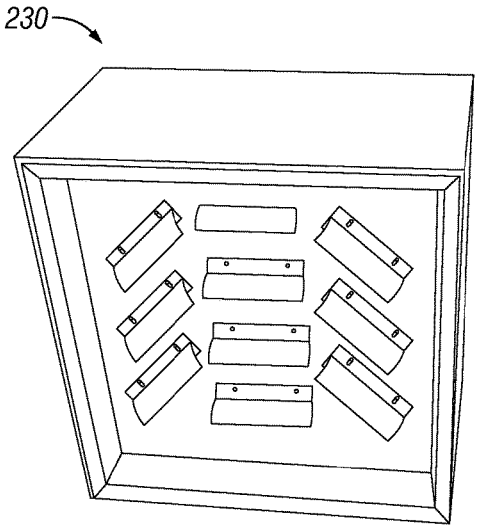
FIG. 15 is a perspective view of the lighting surface of an exemplary alternative ten panel illumination system constructed in accordance with the principles of the present invention.
Figure 16:
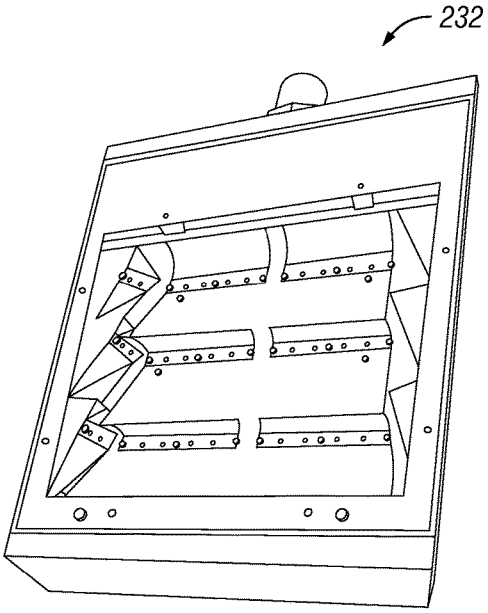
FIG. 16 is a perspective view of the lighting surface of an exemplary alternative wave surface illumination system constructed in accordance with the principles of the present invention.
Figure 17:
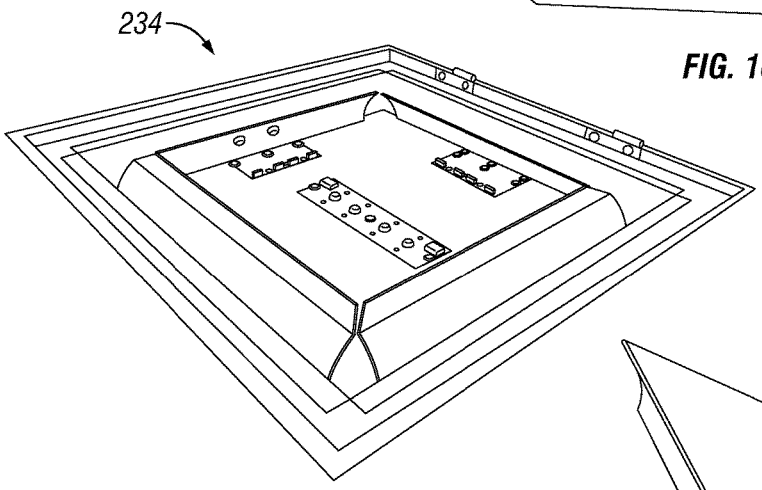
FIG. 17 is a perspective view of the lighting surface of an exemplary alternative square illumination system constructed in accordance with the principles of the present invention.

Other exemplary embodiments are shown in FIGS. 15-18. For example, a ten panel (reflector) system, generally designated 230, is shown in FIG. 15. A rectangular illumination system, generally designated 232, include a wave shaped reflector arrangement as shown in FIG. 16. FIG. 17 depicts yet another embodiment, generally designated 234 in the form of a square reflector arrangement with all reflectors facing inwardly.

Figure 18:
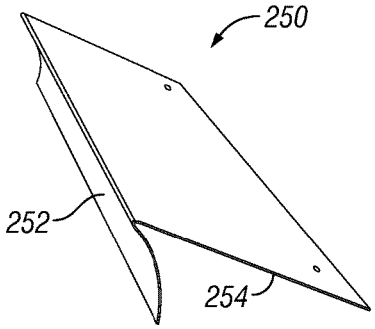
FIG. 18 is a perspective view of an alternative reflector constructed in accordance with the principles of the present invention.

In addition to varying the housing, primary reflective surface, and reflector arrangement, the reflectors themselves may take on other shapes than a simple curve. As shown in FIG. 18 for example, the reflector, generally designated 250, includes a curved LED facing surface 252 with a planar back surface 254. Other suitable reflector shapes will occur to one of ordinary skill in the art.

The Illumination System in Use:

Referring now to FIGS. 1-8, the primary reflector unit 40 may be nested against the chassis or base 38. Four bolts 192*a-d* inserted through the corresponding aperture/slot pairings 88/96, 90/98, 92/100, and 94/102 in conjunction with complementary nuts are used to fasten the primary reflector unit 40 to the base 38 in the designated apertures. The LED-reflector assemblies 50, 52, 54, 56 may be assembled together (PCB, reflector, optional heat sink/spacer) and inserted into their corresponding primary reflector apertures 42, 44, 46, 48 and fastened in place. The side kick reflectors 150, 152 may be fastened to the interior surfaces of the side walls 80, 82, 84 of the primary reflector 40. The entire assembly may then be inserted into an external housing 22 through the opening 25 (or other access slot) and the lens 34 inserted in place to form an illumination system 20 that may be coupled to a support post 24 in an indoor or outdoor setting such as a parking lot or tennis court. Each PCB 106, 108, 110, 112 with their respective LED arrays may be coupled to the power source 176 via a wiring harness 178 or other suitable connection so that the LEDs may be energized. The LED arrays may be programmed to illuminate at certain times as would be understood by one of ordinary skill in the art.

Figure 12:
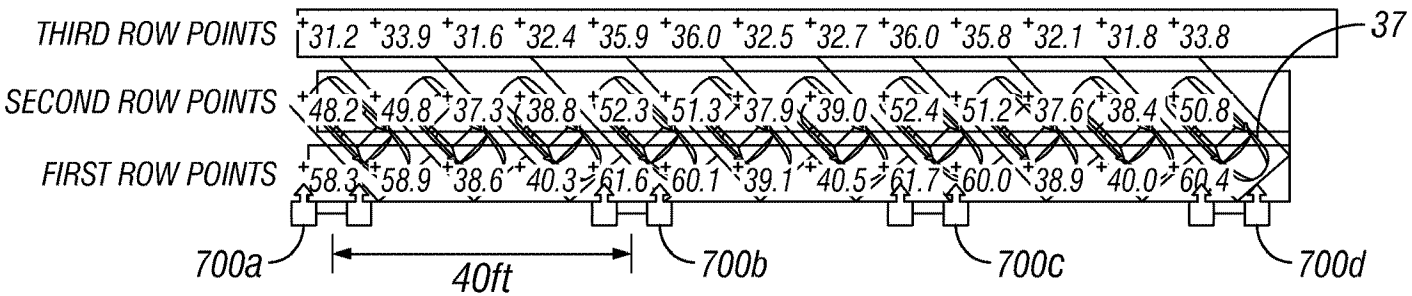
FIG. 12 is an exemplary parking lot illumination schematic showing photometric readings taken about the parking lot.
Figure 13:
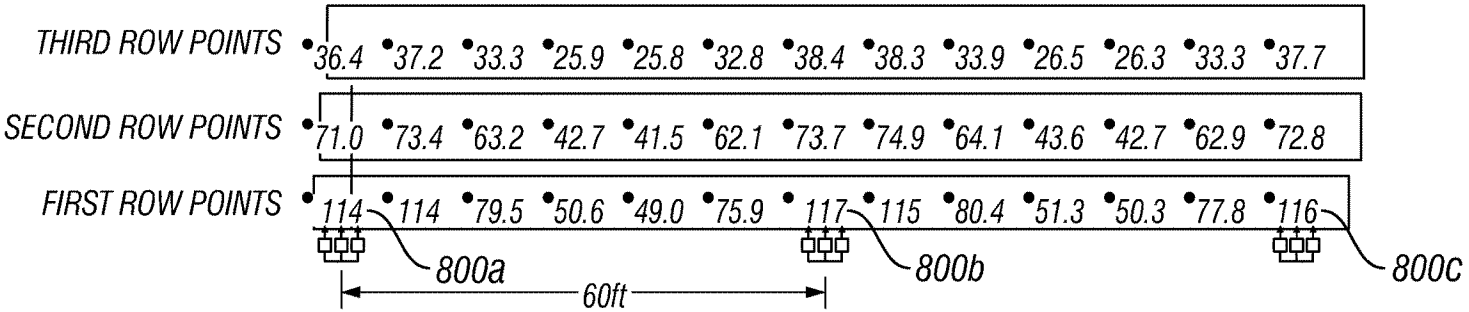
FIG. 13 is an alternative exemplary parking lot illumination schematic showing photometric readings taken about the parking lot.

Referring now to FIGS. 12-13, a pair of exemplary lighting configurations situated in a parking lot is shown. In the first example as in FIG. 12, a set of four lampposts 700*a-d* is shown, each lamppost having a pair of 450 W illumination systems 20 arranged side by side and casting light in the same general direction (a D180 arrangement). In this exemplary embodiment, the lampposts are spaced apart forty feet on center. Illuminance measurements are taken at height of three feet above the grade (parking lot surface) with the illumination systems positioned twenty-five feet above the grade. Measurement points were taken over thirteen columns of three rows deep across roughly ten, slanted side by side parking spots. As shown in the calculation summary table 702 and reading from column by column from left to right, the first row illuminance is 58.3 foot-candles (Fc), the second row illuminance is 48.2 Fc, and the third row illuminance is 31.2 Fc. In the second column, the first row illuminance is 58.9 Fc, the second row illuminance is 49.8 Fc, and the third row illuminance is 33.9 Fc. In the third column, the first row illuminance is 38.6 Fc, the second row illuminance is 37.3 Fc, and the third row illuminance is 31.6 Fc. In the fourth column, the first row illuminance is 40.3 Fc, the second row illuminance is 38.8 Fc, and the third row illuminance is 32.4 Fc. In the fifth column, the first row illuminance is 61.6 Fc, the second row illuminance is 52.3 Fc, and the third row illuminance is 35.9 Fc. In the sixth column, the first row illuminance is 60.1 Fc, the second row illuminance is 51.3 Fc, and the third row illuminance is 36.0 Fc. In the seventh column, the first row illuminance is 39.1 Fc, the second row illuminance is 37.9 Fc, and the third row illuminance is 32.5 Fc. In the eighth column, the first row illuminance is 40.5 Fc, the second row illuminance is 39.0 Fc, and the third row illuminance is 32.7 Fc. In the ninth column, the first row illuminance is 61.7 Fc, the second row illuminance is 52.4 Fc, and the third row illuminance is 36.0 Fc. In the tenth column, the first row illuminance is 60.0 Fc, the second row illuminance is 51.2 Fc, and the third row illuminance is 35.8 Fc. In the eleventh column, the first row illuminance is 38.9 Fc, the second row illuminance is 37.6 Fc, and the third row illuminance is 32.1 Fc. In the twelfth column, the first row illuminance is 40.0 Fc, the second row illuminance is 38.4 Fc, and the third row illuminance is 31.8 Fc. In the thirteenth column, the first row illuminance is 60.4 Fc, the second row illuminance is 50.8 Fc, and the third row illuminance is 33.8 Fc. The rest of the chart in FIG. 12 shows a column for calculation type 704, units 706, averages 708, maximums 710, minimums 712, Avg/Min ratios 714, and Max/Min ratios 716 by first row points 720, second row points 722, and third row points 724. The calculation points 718 are based on levels of illumination every ten feet.

In the second parking lot lighting configuration as shown in FIG. 13, there are thirteen measurement columns, generally representing fifteen parking spots, with first, second, and third row measurement points as well. In this example, a set of three illumination systems 800*a-c*, each with three 615 W lamps facing the same direction and spaced apart sixty feet on center are used. The lamps are elevated to eighteen feet in this example. Reading column by column and from left to right, in the first measurement column, the first row illuminance is 114 Fc, the second row illuminance is 71.0 Fc, and the third row illuminance is 36.4 Fc. In the second measurement column, the first row illuminance is 114 Fc, the second row illuminance is 73.4 Fc, and third row illuminance is 37.2 Fc. In the third measurement column, the first row illuminance is 79.5 Fc, the second row illuminance is 63.2 Fc, and third row illuminance is 33.3 Fc. In the fourth measurement column, the first row illuminance is 50.6 Fc, the second row illuminance is 42.7 Fc, and third row illuminance is 25.9 Fc. In the fifth measurement column, the first row illuminance is 49.0 Fc, the second row illuminance is 41.5 Fc, and third row illuminance is 25.8 Fc. In the sixth measurement column, the first row illuminance is 75.9 Fc, the second row illuminance is 62.1 Fc, and third row illuminance is 32.8 Fc. In the seventh measurement column, the first row illuminance is 117 Fc, the second row illuminance is 73.7 Fc, and third row illuminance is 38.4 Fc. In the eighth measurement column, the first row illuminance is 115 Fc, the second row illuminance is 74.9 Fc, and third row illuminance is 38.3 Fc. In the ninth measurement column, the first row illuminance is 80.4 Fc, the second row illuminance is 64.1 Fc, and third row illuminance is 33.9 Fc. In the tenth measurement column, the first row illuminance is 51.8 Fc, the second row illuminance is 43.6 Fc, and third row illuminance is 26.5 Fc. In the eleventh measurement column, the first row illuminance is 50.3 Fc, the second row illuminance is 42.7 Fc, and third row illuminance is 26.3 Fc. In the twelfth measurement column, the first row illuminance is 77.8 Fc, the second row illuminance is 62.9 Fc, and third row illuminance is 33.3 Fc. In the thirteenth measurement column, the first row illuminance is 116 Fc, the second row illuminance is 72.8 Fc, and third row illuminance is 37.7 Fc. The rest of the chart in FIG. 13 shows similar data to the chart in FIG. 12 is numbered similarly. Both charts 702, 704 depict illuminance readings that represent an improvement of over 30% compared to the nearest known lamps.

The reflector based illumination system also adds additional horizontal and vertical range to the light distribution compared to other technologies. Because similar uniform high light levels can now be spread across a wider horizontal plane such as a tennis court or basketball court without having the need to tilt. The reflector based illumination system is able to achieve the lighting uniformity requirements of the USTA and ASBA PPA (Primary Playing Area) requirements which extend ten feet beyond the base line and six feet to the sides of the doubles lines with only eight lights per court.

Figure 14B:
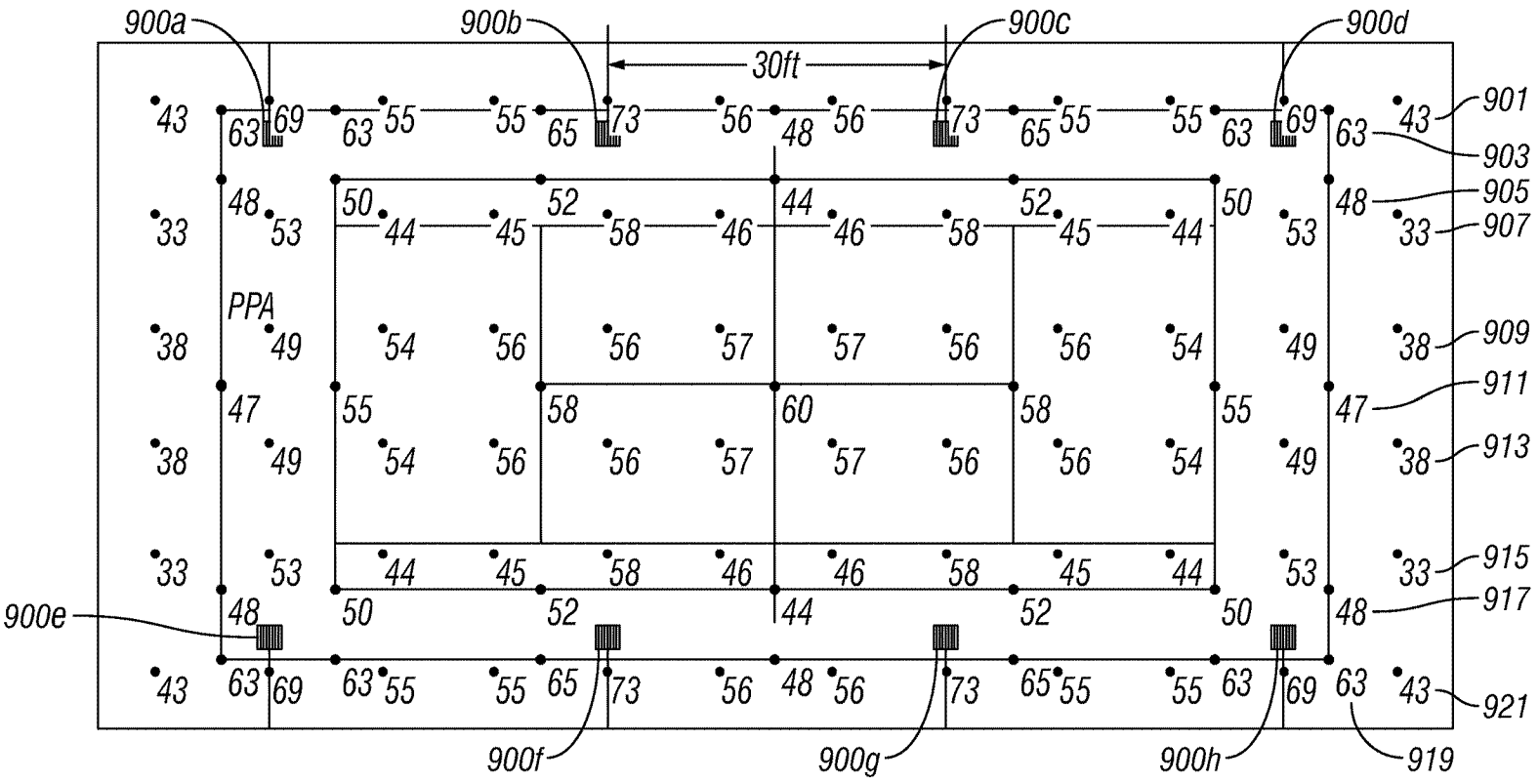
FIG. 14B is an exemplary illumination schematic with photometric readings taken about an exemplary tennis court and relating to the summary table of FIG. 14A.

Referring now to FIGS. 14A-B, an example of the illumination system in work in a tennis court setting. In this example, there are eight illumination systems 900*a-h* (FIG. 14B) on support arranged with thirty foot spacing for covering a conventional tennis court surface of an area sixty feet by one hundred and twenty feet. Each pole includes a single lighting system and the lighting sources in each luminaire are 615 W LEDs maintained at a height of twenty-two feet about the surface of the court and mounted on four foot arms with no rise or tilt. The photometric readings are taken at three feet above the court surface. A number of different photometric readings are illustrated and generally arranged in rows and columns.

Reading from left to right in FIG. 14B, the illuminance readings in foot candles (Fc) taken every ten feet as shown in the uppermost row 901 are as follows: 43, 69, 55, 55, 73, 56, 56, 73, 55, 55, 69, 43. The illuminance readings in the second row 903 are: 63, 63, 65, 48, 65, 63, 63. The illuminance readings in the third row 905 are: 48, 50, 52, 44, 52, 50, 48. The illuminance readings in the fourth row 907 are: 33, 53, 44, 45, 58, 46, 58, 45, 44, 53, 33. The illuminance readings in the fifth row 909 are: 38, 49, 54, 56, 56, 57, 57, 56, 54, 49, 38. The illuminance readings in the sixth row 911 are: 47, 55, 58, 60, 58, 55, 47. The illuminance readings in the seventh row 913 are: 38, 49, 54, 56, 56, 57, 57, 56, 56, 54, 49, 38. The illuminance readings in the eighth row 915 are: 33, 53, 44, 45, 58, 46, 46, 58, 45, 44, 53, 33. The illuminance readings in the ninth row 917 are: 48, 50, 52, 44, 52, 50, 48. The illuminance readings in the tenth row 919 are: 63, 63, 65, 48, 65, 63, 63. The illuminance readings in the eleventh row 921 are: 43, 69, 55, 55, 73, 56, 56, 73, 55, 55, 69, 43.

It will be appreciated that the illuminance readings for the first row 901, fourth row 907, fifth row 909, seventh row 913, eighth row 915, and eleventh row 921 are taken at ten foot intervals. On the other hand, illuminance readings for the second row 903, third row 905, sixth row 911, ninth row 917, and tenth row 919 are a separate calculation for individual stats based on the ASBA/USTA standard of a certain distance measured 10' behind base line and 6' off the doubles line as well as certain points along the court lines.

As shown in the Statistical Area Summary chart 902 of FIG. 14A, there is a label column 904, a CalcType (illuminance) column 906, a units (Fc) column 908, an average column 910, maximum column 912, minimum column 914, average/minimum ratio column 916, and maximum/minimum ratio column 918 and a number of rows 920*a-i* for the individual measurements Entire Court, PPA1-7, and PPA. As shown in the chart, the overall average for the entire court 52.22 Fc with a maximum of 73.0 Fc and a minimum of 33.0 Fc.

As the lighting systems 20, 320, 520 described herein throw more light than conventional lighting fixtures, it will be appreciated that for new construction, the amount of material required for lighting poles and fixtures is reduced since fewer lighting fixtures are needed to illuminate the same area. Moreover, less energy is required to achieve the Illuminating Engineer Society (IES) minimum foot-candle or lux requirements for a given project compared to current LED optical technologies. This results in significant cost savings due to fewer materials, lower installation costs, and lower electric bills. Society also benefits environmentally from the added energy savings through lower carbon emissions, lower demand from the utilities that produce electricity, as well as the lower required materials pulled and transported from the earth.

The entire illumination system 20, 320, 520 may include the housing or exclude the housing and be offered as a retrofit kit including the chassis, insert, and LED-reflector assemblies. For a retrofit project, the illumination systems 20, 320, 520 as described and claimed herein enable lower wattage as well as fewer fixtures be used compared to the current technology to meet the IES minimum foot-candle standards for a given project. Use of the reflector based illumination system enables initial cost savings for a project because lower wattage fixtures require fewer LED's and Drivers and less expensive. Society benefits through the lower energy and materials consumption.

The illumination system may be used with almost any fixture design, regardless of housing shape, including modern, tradition, square, round, bell, cobra head, scoop, or other style housing while bringing energy and material savings to any commercial or architecturally designed project. The housing merely provides a decorative aspect of the design while the reflector system is really the heart of any light fixture design. In addition, the primary reflector surface may be square, rectangular, round, triangular, trapezoidal, or other polygonal shape, or combination thereof as well as being a single unitary piece or a multi-piece structure. Portions of the each reflector surface may be adjacent or spaced apart, including gaps or notches and may include segments as well. In addition to side and top kicker reflectors, front and rear kicker reflectors may be used to throw light in alternative directions. For example, one or more kick reflector surfaces may be positioned in front of an LED array to create another light direction path. In general terms, the horizontal viewing angles (sideways to the fixture) feature the same vertical range as the light emitted forward. This enables casting light in both sideways and forward directions from the same panel providing a photometric advantage.

The illumination systems 20, 320, 520 are adjustable. These systems include reflective light panels of an elliptical or bent nature that can have their angle of reflections adjusted to maximize the light level application efficiency depending on the existing project's physical constraints of mounting height, fixture spacing, and project dimension. The panels may be rotated or aligned in different locations depending on the required target area of illumination. Light levels can be increased or decreased at any given vertical angle to best meet the lighting requirements of the site. The reflector based illumination systems may be directed at any vertical or horizontal angle during the assembly of the fixture based on any given project application, physical geography, mounting height, and fixture spacing. The reflector panels be added to increase light output at any location within the fixture. The reflector panels may also be lengthened or shortened depending on the lighting application. The technology described herein is a recessed light source technology in which the individual LED light sources are located well within the fixture and hidden from view. The horizontal plane of the fixture is a flat tempered glass lens which insures that there can be zero up light and light pollution.

The LED light sources cannot be viewed typically beyond five mounting heights of each individual fixture making it a neighborhood friendly lighting system. The end result of the reflector based illumination system is that such system emits a wider and longer three dimensional horizontal and vertical distribution light pattern in terms of length, width, and height than any current technology. It also reduces the amount of materials, installation, and electricity required to meet IES standards. The reflector based illumination system also has far less glare than most current technology because the LEDs and panels are recessed within the fixture body and have no exposure below the horizontal surface of the light fixture.

Figure 19:
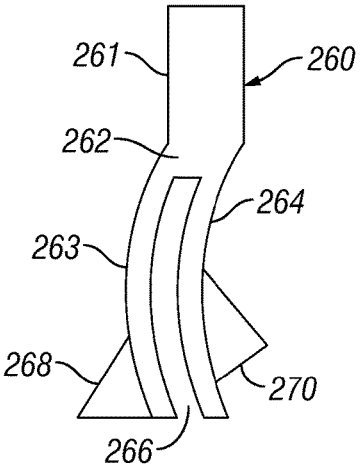
FIG. 19 is a side view of a tool constructed to adjust the reflectors of the illumination system in accordance with the principles of the present invention.
Figure 20:
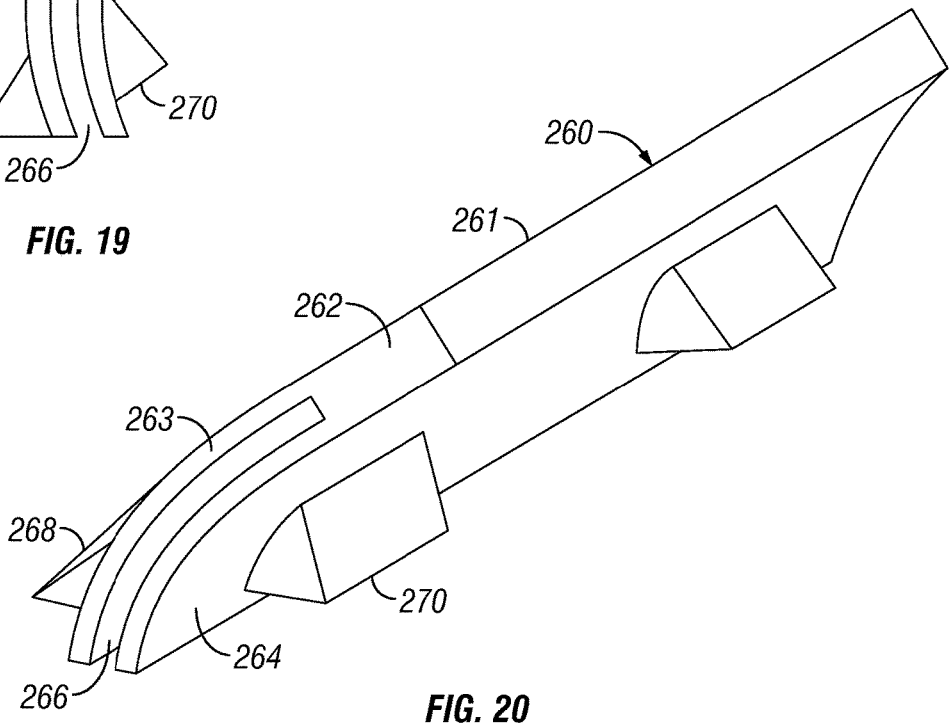
FIG. 20 is a perspective view of the tool of FIG. 19.
Figure 21:
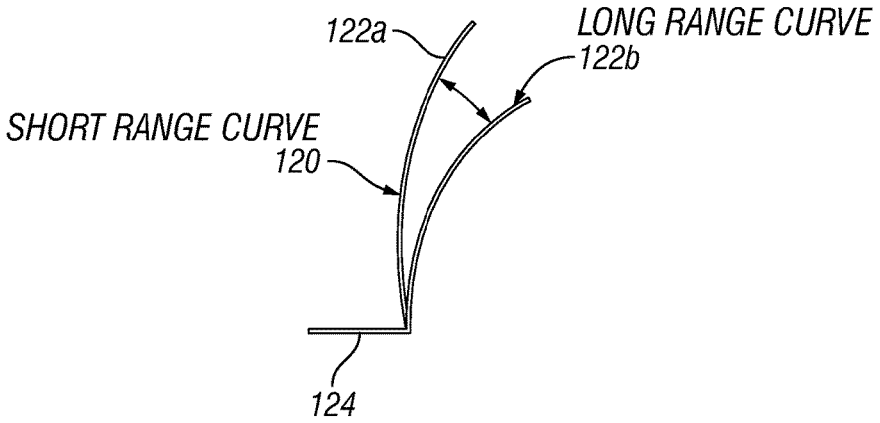
FIG. 21 is a side view of an exemplary reflector illustrating short and long range configurations as adjustable by the tool of FIGS. 19-20.

Referring now to FIGS. 19-21, it will further be appreciated that the reflectors described herein are not only adjustable at a maintenance facility, either before or after installation, but also adjustable in the field providing a significant advantage over those illumination systems that must be removed from the support pole, taken to a maintenance facility, and adjusted there. For example, as shown in FIG. 21, the reflectors 120 may be changed from a long range configuration 122*a* to a short range configuration 122*b* or vice-versa in the field using an adjustment tool 260 (FIGS. 19-20). The tool 260 includes a handle section 261 and a working section 262 with a curved slot 266 between two opposing tines 263, 264. A short range stop 268 in the form of a roughly triangular fin projects outwardly from the outer tine 263 while a long range stop 270, also in the form of a roughly triangular fin projects outwardly from the inner tine 264. In use, the adjuster (user) inserts the fin 122 of the reflector 120 in between the tines 263, 264 of the adjustment tool 260 to load the reflector into the curved slot 266. It will be appreciated that the curvature of the slot in the adjustment tool is selected to generally match the curvatures or contour of the reflector. Once the tines are bottomed out against the base 124 of the reflector 120, the adjuster bends the tool until the desired stop 268 or 270 abuts the base of the reflector or PCB. In such manner, the reflectors may be bent between a short range position and a long range position as shown in FIG. 21. This adjustment between long range and short range positions is in addition to the adjustments of the reflectors relative to their PCB bases by changing the angles, changing the angles of elevation on the support pole, or changing the height of the illumination system on the support pole as well. Thus, it will be appreciated that adjustments may be made to the illumination system height, angle of elevation or rotation, as well individual or group adjustments to the reflectors both in curvature or angle to the LEDs and angle with respect to the underling PCBs, all taking place in the field or at a maintenance facility. However, the ability to adjust in the field is a significant advantage as the impact of the change may be seen right away thus lowering the maintenance costs for removing the illumination system, transporting the system back to the shop, making the adjustments, and reinstalling the system on the support pole. In addition, being able to adjust in the field also avoids multiple trips to the maintenance shop to ensure the adjustment is correct.

The construction of the reflector based illumination will typically consist of a circuit board with a minimum of one LED. The LED has a reflector behind it which can have its angle adjusted to best meet the lighting application. The reflector can be increased or decreased in height as well as length. The circuit board is mounted to the fixture which has the fixture surface or heat sink which draws the heat away from the LED. The circuit board may also have a heat transfer gasket between itself and the fixture body or between itself and the heat sink.

It will further be appreciated that the money saved on a project can be significant. For outdoor lighting each lighting pole installed requires a concrete footing, rebar, conduit, the pole, boom lift, the labor required for installation, and the materials cost of the poles and fixtures themselves. Every pole location saved due to the reflector based illumination system may total $5,000 to $10,000 per unit for the owner of the project. The reflector based illumination system has the ability to save five to fifteen poles per medium size project. The reflector based illumination system is also unique in that it also allows for lower mounting heights compared to current LED technology.

The reflector based illumination system will also decrease light pollution because it has its LEDs deeply recessed within the fixture and they do not extend below the horizontal plane of the bottom of the fixture housing. There is no uplight at any angle. LEDs are now white light sources replacing amber high pressure sodium light sources and errant light which travels towards space cannot be filtered by telescopes as can high pressure sodium amber light. The reflector based illumination system has the ability to provide IES recommended light levels at lower heights compared to the competition also provides less light pollution for residences that are proximate to the project because the lighting is confined to a lower fixture mounting height and the volume of light required by a project is significantly less. The reflector based illumination system also does not require tilting to throw light at a great distance. Other commercially available lighting systems do require tilting. Tilting causes wasted lumens which travel into the atmosphere and increase light pollution both for astronomy and neighborhoods. The International Dark Sky Association states that light photons emanating from a single man made light source can travel 87 miles when unobstructed.

Certain objects and advantages of the invention are described herein. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure.

It is also contemplated that various combinations or sub-combinations of the specific features and aspects of the embodiments may be made and still fall within the scope of the invention. Accordingly, it should be understood that various features and aspects of the disclosed embodiments may be combined with or substituted for one another in order to form varying modes of the disclosed invention. Thus, it is intended that the scope of the present invention herein disclosed should not be limited by the particular disclosed embodiments described above.

What is claimed is:

1. A reflector based illumination system for use with a housing in communication with a power source and having at least one opening for illuminating an exterior surface, the system comprising:

a mounting insert having at least one primary reflective surface recessed from the opening of the housing when the mounting insert is inserted within the housing;

at least one circuit board releasably secured to the mounting insert and operable to be placed in communication with the power source;

at least one auxiliary reflector coupled to the mounting insert either directly or indirectly, the at least one auxiliary reflector having a first edge proximate the primary reflective surface of the mounting insert, a second opposing free standing distal edge, and a pair of detached free standing opposing side edges spaced apart from the housing with the edges defining a non-planar bendable region, the at least one auxiliary reflector further having an auxiliary reflective surface within the non-planar bendable region; and at least one light source in communication with the at least one circuit board and recessed from the opening within the housing, the at least one light source positioned within the housing to emit a quantity of incident light toward the auxiliary reflective surface of the at least one auxiliary reflector, a quantity of incident light toward the primary reflective surface, and a quantity of unobstructed light through the opening of the housing, with all three quantities cooperating to illuminate the exterior surface when the light source is placed in communication with the power source through the circuit board and energized to generate light.

2. The system of claim 1 further including:

a lens held in place by the housing and covering the opening while allowing light to pass through, the lens being substantially parallel to the primary reflective surface.

3. The system claim 1 wherein:

the light source includes at least one light emitting diode and all light emitted from the at least one light emitting diode is blocked from projecting in the upward direction outside the housing.

4. The system of claim 1 wherein:

the auxiliary reflective surface includes a plurality of alternating sections projecting transversely between the opposing side edges and substantially parallel to the first edge of the auxiliary reflector with adjacent sections having differing degrees of reflectivity.

5. The system of claim 1 wherein:

the auxiliary reflective surface includes a series of alternating stripes projecting transversely between opposing side edges and substantially parallel to the first edge of the auxiliary reflector with adjacent stripes being polished to differing degrees.

6. The system of claim 1 wherein:

the non-planar bendable region of the at least one auxiliary reflector is curved between the first edge and the free standing distal edge; and the light source emits light toward a concave facing side of the non-planar region of the reflective surface of the at least one auxiliary reflector.

7. The system of claim 1 wherein:

the at least one auxiliary reflector is constructed to be adjusted independently of the housing by bending the at least one auxiliary reflector about the first edge from a first position into a new position relative to the light emitting diode to adjust the lighting distribution pattern emitted from the housing.

8. The system of claim 1 further comprising:

a plurality of auxiliary reflectors with at least two auxiliary reflectors secured at two non-parallel normal angles relative to one another.

9. The system of claim 1 wherein:

the mounting insert includes at least one aperture; and at least one circuit board includes an LED array providing the light source, the circuit board being connected to at least one auxiliary reflector to form an LED-reflector assembly at least partially fits within the aperture.

10. The system of claim 1 further including:

at least one side kicker connected to the mounting insert proximate an interior surface of an outer wall of the housing and including a side kicker reflective surface presenting a surface with a normal direction crossing a normal direction from the at least one auxiliary reflector.

11. The system of claim 10 wherein:

the at least one side kicker reflector includes a series of steps presenting first and second angled reflective surfaces.

12. The system of claim 1 wherein:

the at least one auxiliary reflector is curved and coupled to the at least one circuit board, either directly or indirectly, and positioned with the free standing distal edge closer to a vertical plane passing through the light source in communication with the at least one circuit board than the proximate edge.

13. A method of illuminating a surface with a reflector based illumination system using a support post proximate the surface, the method comprising:

providing a housing having at least one opening;

securing an insert having a primary reflective surface to the housing;

securing the housing to the support post to elevate the housing above the surface outside the housing to be illuminated;

removably securing a plurality of LED-reflector assemblies to the insert within the housing, at least one LED-reflector assembly including a circuit board with an array of light emitting diodes positioned between the primary reflective surface and the at least one opening, the at least one LED-reflector assembly further including a bendable, reflector panel with a first edge proximate the primary reflective surface, an opposing free distal edge, and a pair of opposing free side edges spaced apart from the housing, the reflector panel including a secondary reflector surface to reflect a quantity of light emitted from the light emitting diode and out through the at least one opening and supplement light reflected off the primary reflective surface, the secondary reflector surface being curved between the first edge and opposing distal edge;

providing a power source for energizing the circuit board of the at least one LED-reflector assembly; and connecting the power source to the circuit board of the at least one LED-reflector assembly to energize the corresponding light emitting diodes to cast light onto the surface to be illuminated, the light consisting of a quantity of light reflected off the primary reflective surface, a quantity of light reflected off the secondary reflector surface, and a quantity of unreflected light.

14. The method of claim 13 further including the step of:

positioning at least two of the LED-reflector assemblies with the normal directions of their respective reflector panels in a parallel arrangement.

15. The method of claim 13 further including the step of:

positioning at least two of the LED-reflector assemblies with the normal directions of their respective reflector panels in a converging arrangement.

16. The method of claim 13 further comprising the steps of:

slipping a forked tool over the distal free edge of a selected reflector panel; and using the forked tool to adjust the selected reflector panel independently of other reflector panels by bending the selected reflector panel about its corresponding first edge to a new position to alter the light distribution pattern projecting through the lens from the light source reflecting off the selected reflector panel and onto the surface.

17. A reflector based illumination system for illuminating an exterior surface, the system comprising:

a housing having at least one opening at least partially covered by a light transmitting lens;

an insert secured to the housing, the insert including a primary reflective surface spaced apart from the opening;

a support post connected to the housing and spacing the opening of the housing apart from the exterior surface;

a plurality of LED-reflector assemblies removably secured to the insert, at least one LED-reflector assembly including a circuit board with a set of LEDs and a non-planar reflector panel, the reflector panel having a connected edge proximate the primary reflective surface, an opposing free standing distal edge, and a pair of laterally disposed free side edges, the edges defining an auxiliary reflective region constructed to reflect a quantity of light emitted by the set of LEDs out through the opening of the housing, the reflector panel being adjustable from a first position to one or more new positions by bending the reflector panel about the connected edge to reposition the reflector panel to provide a different lighting distribution pattern; and a power source in communication with the circuit board of the at least one LED-reflector assembly and operable to selectively energize the LED arrays to illuminate the exterior surface through the lens with a quantity of light reflected from the reflector panels, a quantity of light reflected off primary reflective surface, and a quantity of unreflected light.

18. The illumination system of claim 17 wherein:

at least one reflector panel has a normal direction that is parallel to a normal direction of at least one other reflector panel of the plurality of LED-reflector assemblies.

19. The illumination system of claim 17 wherein:

at least one reflector panel has a normal direction that converges with a normal direction of at least one other reflector panel of the plurality of LED-reflector assemblies.

20. The illumination system if claim 17 further including:

at least one side kick reflector secured inside a portion of the perimeter of the housing, the side kick reflector including a first section with a first normal direction that crosses a normal direction of at least one reflector panel at an obtuse or an acute angle and a second section with a normal direction that crosses a normal direction of at least one other reflector panel also at an obtuse or an acute angle.

* * * * *